US006619785B1

(12) United States Patent
Sato

(10) Patent No.: US 6,619,785 B1
(45) Date of Patent: Sep. 16, 2003

(54) METHOD OF CONNECTING ELECTRODE, NARROW PITCH CONNECTOR, PITCH CHANGING DEVICE, MICROMACHINE, PIEZOELECTRIC ACTUATOR, ELECTROSTATIC ACTUATOR, INK-JET HEAD, INK-JET PRINTER, LIQUID CRYSTAL DEVICE, AND ELECTRONIC DEVICE

(75) Inventor: Eiichi Sato, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/701,283

(22) PCT Filed: Mar. 31, 2000

(86) PCT No.: PCT/JP00/02069

§ 371 (c)(1),
(2), (4) Date: Dec. 13, 2000

(87) PCT Pub. No.: WO00/59074

PCT Pub. Date: Oct. 5, 2000

(30) Foreign Application Priority Data

Mar. 31, 1999 (JP) ..... 11-094069

(51) Int. Cl.[7] ..... B41J 2/14; B41J 2/16; B41J 2/05

(52) U.S. Cl. ..... 347/50; 347/58

(58) Field of Search ..... 347/58, 68, 50; 439/55, 581; 716/15

(56) References Cited

U.S. PATENT DOCUMENTS 5,861,726 A * 1/1999 Uchikata et al. ..... 318/685
6,042,223 A * 3/2000 Katakura ..... 347/68

FOREIGN PATENT DOCUMENTS

| | | |
|---|---|---|
| JP | 4-182133 | 6/1992 |
| JP | 3007181 | 11/1994 |
| JP | 6-333652 | 12/1994 |
| JP | 7-65885 | 3/1995 |
| JP | 8-330506 | 12/1996 |
| JP | 9-92362 | 4/1997 |
| JP | 10-247118 | 9/1998 |
| JP | 11-42779 | 2/1999 |

* cited by examiner

*Primary Examiner*—Thinh Nguyen
(74) *Attorney, Agent, or Firm*—Oliff & Berridge, PLC

(57) ABSTRACT

An electrode connecting method, a narrow-pitch connector, a pitch converter, a micro-machine, a piezoelectric actuator, an electrostatic actuator, an ink jet head, an ink jet printer, a liquid crystal device and electronic equipment, in which even if connecting subjects having different thermal expansion coefficients are connected with each other, the positional deviation between the terminal electrodes of the connecting subjects can be restrained.

After terminal electrodes (28) of a connecting subject (26) are put on top of terminal electrodes (30) of a narrow-pitch connector (20), thermal compression bonding is performed on these terminal electrodes so that the terminal electrodes are connected with each other. A temperature difference between the connecting subject (26) and the narrow-pitch connector (20) is established so that the pitch of the terminal electrodes (28) provided on the connecting subject (26) and the pitch of the terminal electrodes (30) on the connector become equal to each other at the time of heating. Thus, the connection is performed. If a substrate (22) and the connecting subject (26) are formed of silicon, precise connection can be achieved.

19 Claims, 17 Drawing Sheets

(a)

(b)

METHOD OF CONNECTING ELECTRODE, NARROW PITCH CONNECTOR, PITCH CHANGING DEVICE, MICROMACHINE, PIEZOELECTRIC ACTUATOR, ELECTROSTATIC ACTUATOR, INK-JET HEAD, INK-JET PRINTER, LIQUID CRYSTAL DEVICE, AND ELECTRONIC DEVICE

TECHNICAL FIELD

The present invention relates to an electrode connecting method, a narrow-pitch connector with terminals connected by this connecting method, a pitch converter, a micromachine, a piezoelectric actuator, an electrostatic actuator, an ink jet head, an ink jet printer, a liquid crystal device, and electronic equipment.

BACKGROUND ART

Recently, electronic equipment has been developed remarkably, and the degree of integration per unit area has been enhanced as the electronic equipment has been made smaller in size, lighter in weight and larger in capacity. In the present circumstances, however, the technical advance of peripheral portions of the electronic equipment lags behind relatively, and there is no proposal particularly to make terminal electrodes of a connection portion finer.

Connecting subjects such as printer heads (hereinafter referred to as "printer engine portions") having piezoelectric elements for blasting ink by the vibration of the piezoelectric elements, LCD cells of liquid crystal devices, or the like, have been made finer year by year, so that the interval between terminal electrodes has become narrower correspondingly. To connect a driving circuit to such a connecting subject, a connector constituted by a flexible substrate is hitherto attached to convert the pitch of a wiring pattern so as to make a connection with the driving circuit.

This connection will be described in detail with reference to the drawings. FIG. 17 is a main portion enlarged view of a connecting subject and a connector constituted by a flexible substrate. As shown in FIG. 17, in a connecting subject 1 such as a printer engine portion, an LCD cell of a liquid crystal device, or the like, a plurality of wirings 2 connected with elements are drawn around on the surface of the connecting subject 1, and terminal electrodes 3 are formed in end portions of the connecting subject 1.

On the other hand, a connector 4 for making a connection with the connecting subject 1 is formed of a flexible substrate the material of which is composed of polyimide. Terminal electrodes 5 which can be put on the terminal electrodes 3 respectively formed in the end portions of the connecting subject 1 are formed at one end of this substrate while terminal electrodes 6 which are wider than the terminal electrodes 5 and which are disposed at larger intervals than the terminal electrodes 5 are formed in the end portion opposite to the terminal electrodes 5. Wirings 6A are provided to connect the terminal electrodes 5 with the terminal electrodes 6 so that the width and intervals are changed on the way where the wirings 6A are drawn around.

FIG. 18 is an explanatory view showing the process of connecting the connecting subject 1 with the connector 4. As shown in FIG. 18, in the case where the aforementioned connecting subject 1 and the aforementioned connector 4 are connected with each other, the connecting subject 1 is first disposed on a bonding stage 7 so that the terminal electrodes 3 are located on the upper surface side. Next, positioning is performed between the terminal electrodes 5 provided on the connector 4 and the aforementioned terminal electrodes 3 so that both the terminal electrodes are put on top of each other. Incidentally, a bonding agent containing electrically conductive particles are applied between the terminal electrodes 3 and the terminal electrodes 5 so that both the terminal electrodes are made electrically conductive with each other through the electrically conductive particles.

Here, a bonding tool 8 which can move up and down is provided above the position where both the electrodes are put on top of each other, that is, above the terminal electrodes 5 in the connector 4. Incidentally, the bonding tool 8 includes a heater 9 so that a front end portion of the bonding tool 8 can be heated by operating this heater 9.

By moving down the bonding tool 8 configured thus, both the electrodes are connected with each other while not only is it intended to bring both the electrodes into close contact with the electrically conductive particles but also it is intended to shorten the time to dry the bonding agent by heating. Incidentally, when both the electrodes are connected with each other, the bonding agent containing electrically conductive particles is not always required. Both the electrodes may be welded or metal-bonded by applying pressure and heat to the electrodes which are put on top of each other without any bonding agent therebetween.

Incidentally, although a printer head (printer engine portion) using a piezoelectric element or an LCD cell of a liquid crystal device was described here by way of example, bonding may be performed by a similar technique also in a micro-machine in which a fine moving mechanism portion is formed on a substrate and a wiring for transferring energy (for applying a voltage) to this moving mechanism portion is extracted, a piezoelectric actuator using a piezoelectric element, an electrostatic actuator using an electrostatic vibrator, a printer head using an electrostatic actuator, a printer using such an actuator, and electronic equipment mounted with such apparatus.

However, in the connector or the electrode connecting method described above, there have been technical problems as follows.

FIGS. 19(*a*) and (*b*) show sectional views respectively taken on line C—C in FIG. 18, in which a interval 10 between the terminal electrodes 3 is made narrower correspondingly to the fact that the connecting subject 1 such as a printer engine portion, an LCD cell of a liquid crystal device, or the like, has been made finer year by year as described above. As a result, if the material composing the connecting subject 1 (mainly silicon) and the material composing the connector 4 (mainly polyimide) are different in thermal expansion coefficient, the thermal expansion of the connector 4 becomes larger due to the influence of the heater 9 included in the bonding tool 8 when the bonding tool 8 is made close to the connecting subject 1 and the connector 4 in order to bond them. As a result, as shown in FIG. 19(*b*), the terminal electrodes 5 are displaced relatively to the terminal connectors 3 respectively. Thus, there has been a fear that there arises a problem such as increase in resistance value or failure in bonding between both the terminals, or short-circuit with adjacent terminals. Incidentally, according to various investigations made by the present inventor, it was confirmed that there was a limit of a wiring pitch near 60 $\mu$m in a connector made of polyimide material.

On the other hand, in the electrode connecting method, heating when both the terminals are connected with each other is performed by the heater 9 included in the bonding tool 8. However, if heating is performed by the heater 9, the temperature of the connector 4 becomes higher than that of the connecting subject 1 so that there arises a temperature difference between the connecting subject 1 and the connector 4. If the thermal expansion coefficient of the material composing the connector 4 is larger than that of the material composing the connecting subject 1, the deviation of the terminal electrodes 5 from the terminal electrodes 3 when both the terminal electrodes are connected with each other increases still more. According to various investigations made by the present inventor, it was confirmed that the temperature was in a range of from 360° C. to 400° C. at a position a, in a range of from 180° C. to 230° C. at a position b, and about 160° C. at a position c.

Incidentally, in an actuator, or the like, manufactured by use of a micro-machine or micro-machining technique, the area of wiring terminals increases in comparison with a moving mechanism portion or an actuator portion because the actuator is connected with an external board by a method of flexible-substrate or wire bonding, wire cable soldering, or the like. In order to form such a moving mechanism portion or actuator, precise machining represented by anisotropic etching is required, and an expensive material or an expensive machine is also required. It is therefore desired that the area of wiring terminal portions is made so minimal that the moving mechanism portion or actuator is manufactured efficiently.

DISCLOSURE OF THE INVENTION

It is an object of the present invention to provide an electrode connecting method in which, even if terminal electrodes of connecting subjects having different thermal expansion coefficients are connected with each other, the positional deviation between these terminal electrodes to be connected with each other can be restrained; and a narrow-pitch connector in which the positional deviation between terminal electrodes to be connected with each other can be reduced even if thermal stress is applied; a pitch converter; a micro-machine; a piezoelectric actuator; an electrostatic actuator; an ink jet head; an ink jet printer; a liquid crystal device; and electronic equipment.

(1) According to an aspect of the present invention, there is provided a narrow-pitch connector in which a plurality of first terminal electrodes and a plurality of second terminal electrodes are formed on a substrate, and wiring is formed for electrically connecting the first terminal electrodes with the second terminal electrodes; wherein the wiring has a function of making a conversion from a pitch of the first terminal electrodes to a pitch of the second terminal electrodes.

(2) According to another aspect of the present invention, in the narrow-pitch connector stated in the above paragraph (1), the substrate is formed of silicon.

(3) According to another aspect of the present invention, in the narrow-pitch connector stated in the above paragraph (1), the first terminal electrodes are arranged so that the pitch of the first terminal electrodes is set to be not larger than 60 $\mu$m.

(4) According to another aspect of the present invention, in the narrow-pitch connector stated in the above paragraph (1), the second terminal electrodes are arranged so that the pitch of the second terminal electrodes is set to be not smaller than 80 $\mu$m.

(5) According to another aspect of the present invention, in the narrow-pitch connector stated in the above paragraph (1), the second terminal electrodes are terminal electrodes for making a connection with a flexible substrate such as a flexible board, a tape carrier package, or the like.

In the aforementioned inventions (1) to (5), the substrate of the narrow-pitch connector for making a conversion from the pitch of the first terminal electrodes to the pitch of the second terminal electrodes by the wiring is formed of silicon. Accordingly, the connector can have a small thermal expansion coefficient and be formed in the same manner as the process for forming a semiconductor device. Therefore, the wiring can be easily formed with a narrow pitch.

In addition, the terminal pitch of the first terminal electrodes of the narrow-pitch connector is set to be not larger than 60 $\mu$m. Such terminal electrodes with a narrow pitch not larger than 60 $\mu$m cannot be formed in any background-art connector, but can be attained for the first time by the narrow-pitch connector according to the present invention.

Further, the terminal pitch of the second terminal electrodes of the narrow-pitch connector is set to be not smaller than 80 $\mu$m. By extending the terminal pitch of the second terminal electrodes to be not smaller than 80 $\mu$m thus, the terminal pitch of the second terminal electrodes can be easily adjusted to that of the terminals on the side of a flexible-substrate such as a flexible board, a tape carrier package, or the like, and a stable connection can be made with such a flexible substrate.

(6) According to another aspect of the present invention, there is provided a pitch converter which comprises: a narrow-pitch connector in which a plurality of first terminal electrodes and a plurality of second terminal electrodes are formed on a substrate, and wiring is formed for electrically connecting the first terminal electrodes with the second terminal electrodes; and a connecting subject having external electrodes which are to be electrically connected with the first terminal electrodes.

(7) According to another aspect of the present invention, in the pitch converter stated in the above paragraph (6), the substrate has a characteristic that a thermal expansion coefficient thereof is substantially equal to or smaller than a thermal expansion coefficient of the connecting subject.

(8) According to another aspect of the present invention, in the pitch converter stated in the above paragraph (6), the substrate and the connecting subject are formed of the same material.

(9) According to another aspect of the present invention, in the pitch converter stated in the above paragraph (6), the substrate and the connecting subject are formed of silicon.

(10) According to another aspect of the present invention, in the pitch converter stated in the above paragraph (6), the first terminal electrodes are electrically connected with the external electrodes through electrically conductive members.

In the aforementioned inventions (6) to (10), the substrate of the narrow-pitch connector has a characteristic that the thermal expansion coefficient of the substrate is substantially equal to or smaller than that of the connecting subject. Accordingly, when the first terminal electrodes of the connector and the external electrodes of the connecting subject are connected with each other by pressing and heating, both the electrodes are lengthened by substantially the same quantity so that the relative positional deviation of the electrodes which are put on top of each other can be restrained to the minimum.

In addition, because the substrates of the narrow-pitch connector and the connecting subject are formed of the same material, the relative positional deviation of the electrodes can be restrained when the electrodes are put on top of each other.

Further, because silicon which is high in heat conductivity is used as the material of the substrate of the narrow-pitch connector and the connecting subject, the effect of heat radiation can be more enhanced so that the resistance value can be prevented from increasing due to temperature rise.

Moreover, because the first terminal electrodes of the connector and the external electrodes of the connecting subject are connected with each other through the electrically conductive members, the electric connection between both the electrodes can be made more reliable.

(11) According to another aspect of the present invention, there is provided a method for connecting electrodes, by which terminal electrodes formed in a narrow-pitch connector having a pitch converting function are respectively connected with external electrodes formed in a connecting subject; wherein heating conditions are established on the basis of a difference in thermal expansion coefficient between the narrow-pitch connector and the connecting subject, and an area where the terminal electrodes are connected with the external electrodes respectively is pressed and heated.

(12) According to another aspect of the present invention, in the electrode connection method stated in the above paragraph (11), the above mentioned area is heated by a first heater and a second heater from the side of the terminal electrodes and the side of the external electrodes respectively under the aforementioned heating conditions.

In the aforementioned inventions (11) and (12), if the connecting subject is different, the thermal expansion coefficient thereof becomes different. Therefore, heaters are provided on the terminal electrode side and on the external electrode side independently of each other. These heaters are controlled under heating conditions based on the difference in thermal expansion coefficient between the narrow-pitch connector and the connecting subject. Thus, one of the connecting subjects having a smaller thermal expansion coefficient is put on the side of high temperature while the other connecting subject with a higher thermal expansion coefficient is put on the side of low temperature. Then, the temperature difference between the connecting subjects is set so that the distance between the terminal electrodes in one connecting subject is equal to that in the other. As a result, the distance between the terminal electrodes formed in one connecting subject can be made equal to that in the other. Therefore, the terminal electrodes can be connected with each other reliably even if the connecting subjects have different thermal expansion coefficients.

(13) According to another aspect of the present invention, there is provided a micro-machine comprising a moving mechanism portion and a first substrate in which a plurality of first terminal electrodes are formed; wherein: the micro-machine is provided with a second substrate in which second terminal electrodes for making an electric connection with the plurality of first terminal electrodes are formed; a plurality of third terminal electrodes and wiring for electrically connecting the second terminal electrodes with the third terminal electrodes respectively are formed on the second substrate; and the wiring has a function of making a conversion from a pitch of the second terminal electrodes to a pitch of the third terminal electrodes.

In the aforementioned invention (13), in the micro-machine, the first substrate in which the moving mechanism portion of the micro-machine is formed and the second substrate for making a connection with the outside are formed separately. Accordingly, the area of the first substrate can be minimized.

(14) According to another aspect of the present invention, there is provided a piezoelectric actuator comprising a piezoelectric element and a first substrate in which a plurality of first terminal electrodes are formed; wherein: the piezoelectric actuator is provided with a second substrate in which second terminal electrodes for making an electric connection with the plurality of first terminal electrodes are formed; a plurality of third terminal electrodes and wiring for electrically connecting the second terminal electrodes with the third terminal electrodes respectively are formed on the second substrate; and the wiring has a function of making a conversion from a pitch of the second terminal electrodes to a pitch of the third terminal electrodes.

(15) According to another aspect of the present invention, there is provided an electrostatic actuator comprising an electrostatic vibrator and a first substrate in which a plurality of first terminal electrodes are formed; wherein: the electrostatic actuator is provided with a second substrate in which second terminal electrodes for making an electric connection with the plurality of first terminal electrodes are formed; a plurality of third terminal electrodes and wiring for electrically connecting the second terminal electrodes with the third terminal electrodes respectively are formed on the second substrate; and the wiring has a function of making a conversion from a pitch of the second terminal electrodes to a pitch of the third terminal electrodes.

(16) According to another aspect of the present invention, there is provided an ink jet head comprising a piezoelectric element and a first substrate in which a plurality of first terminal electrodes are formed, so as to discharge ink drops by the piezoelectric element; wherein: the ink jet head is provided with a second substrate in which second terminal electrodes for making an electric connection with the plurality of first terminal electrodes are formed; a plurality of third terminal electrodes and wiring for electrically connecting the second terminal electrodes with the third terminal electrodes respectively are formed on the second substrate; and the wiring has a function of making a conversion from a pitch of the second terminal electrodes to a pitch of the third terminal electrodes.

(17) According to another aspect of the present invention, there is provided an ink jet head comprising an electrostatic vibrator and a first substrate in which a plurality of first terminal electrodes are formed, so as to discharge ink drops by the electrostatic vibrator; wherein: the ink jet head is provided with a second substrate in which second terminal electrodes for making an electric connection with the plurality of first terminal electrodes are formed; a plurality of third terminal electrodes and wiring for electrically connecting the second terminal electrodes with the third terminal electrodes respectively are formed on the second substrate; and the wiring has a function of making a conversion from a pitch of the second terminal electrodes to a pitch of the third terminal electrodes.

(18) According to another aspect of the present invention, there is provided an ink jet printer comprising an ink jet head having a piezoelectric element and a first substrate, the first substrate being provided with a plurality of first terminal electrodes formed therein; wherein: the ink jet printer is provided with a second substrate in which second terminal electrodes for making an electric connection with the plurality of first terminal electrodes are formed; a plurality of third terminal electrodes and wiring for electrically connecting the second terminal electrodes with the third terminal electrodes respectively are formed on the second substrate; and the wiring has a function of making a conversion from a pitch of the second terminal electrodes to a pitch of the third terminal electrodes.

(19) According to another aspect of the present invention, there is provided an ink jet printer comprising an ink jet head having an electrostatic vibrator and a first substrate, the first substrate being provided with a plurality of first terminal electrodes formed therein; wherein: the ink jet printer is provided with a second substrate in which second terminal electrodes for making an electric connection with the plurality of first terminal electrodes are formed; a plurality of third terminal electrodes and wiring for electrically connecting the second terminal electrodes with the third terminal electrodes respectively are formed on the second substrate; and the wiring has a function of making a conversion from a pitch of the second terminal electrodes to a pitch of the third terminal electrodes.

In the aforementioned inventions (14), (16) and (18), the first substrate in which a piezoelectric element is formed and the second substrate for making a connection with the outside are formed separately. Accordingly, the area of the first substrate can be minimized.

On the other hand, in the aforementioned inventions (15), (17) and (19), the first substrate in which an electrostatic vibrator is formed and the second substrate for making a connection with the outside are formed separately. Accordingly, the area of the first substrate can be minimized.

(20) According to another aspect of the present invention, there is provided a liquid crystal device in which a liquid crystal is held between a first substrate and a second substrate, and a plurality of first terminal electrodes are formed on either the first substrate or the second substrate; wherein: the liquid crystal device is provided with a third substrate in which second terminal electrodes for making an electric connection with the plurality of first terminal electrodes are formed; a plurality of third terminal electrodes and wiring for electrically connecting the second terminal electrodes with the third terminal electrodes respectively are formed on the third substrate; and the wiring has a function of making a conversion from a pitch of the second terminal electrodes to a pitch of the third terminal electrodes.

In the aforementioned invention (20), the so-called liquid crystal cell in which the liquid crystal is held between the first substrate and the second substrate and in which a plurality of first terminal electrodes are formed in one of the first and second substrates, and the third substrate for making a connection with the outside are formed separately. Accordingly, the area occupied by the first terminal electrodes in the liquid crystal cell can be minimized. Therefore, a large liquid crystal display portion can be ensured in the liquid crystal cell even if the liquid crystal cell having the same area as that in a background-art is used. In addition, because the number of terminals in a connecting portion can be increased easily, the pitch of picture elements can be reduced so that the picture elements can be made precise extremely.

(21) According to another aspect of the present invention, there is provided an electronic equipment comprising a liquid crystal device; wherein the liquid crystal includes a first substrate and a second substrate so that a liquid crystal is held between the first substrate and the second substrate, either the first substrate or the second substrate being provided with a plurality of first terminal electrodes, and further include a third substrate in which second terminal electrodes for making an electric connection with the plurality of first terminal electrodes are formed; a plurality of third terminal electrodes and wiring for electrically connecting the second terminal electrodes with the third terminal electrodes respectively are formed on the third substrate; and the wiring has a function of making a conversion from a pitch of the second terminal electrodes to a pitch of the third terminal electrodes.

In the aforementioned invention (21), the liquid crystal device in the electronic equipment is configured so that the liquid crystal is held between the first substrate and the second substrate, and the so-called liquid crystal cell in which a plurality of first terminal electrodes are formed in one of the first and second substrates, and the third substrate for making a connection with the outside are formed separately. Accordingly, the area occupied by the first terminal electrodes in the liquid crystal cell can be minimized. As a result, miniaturization of the electronic equipment becomes easy.

THE BEST MODE FOR CARRYING OUT THE INVENTION

EMBODIMENT 1

Figure 1:
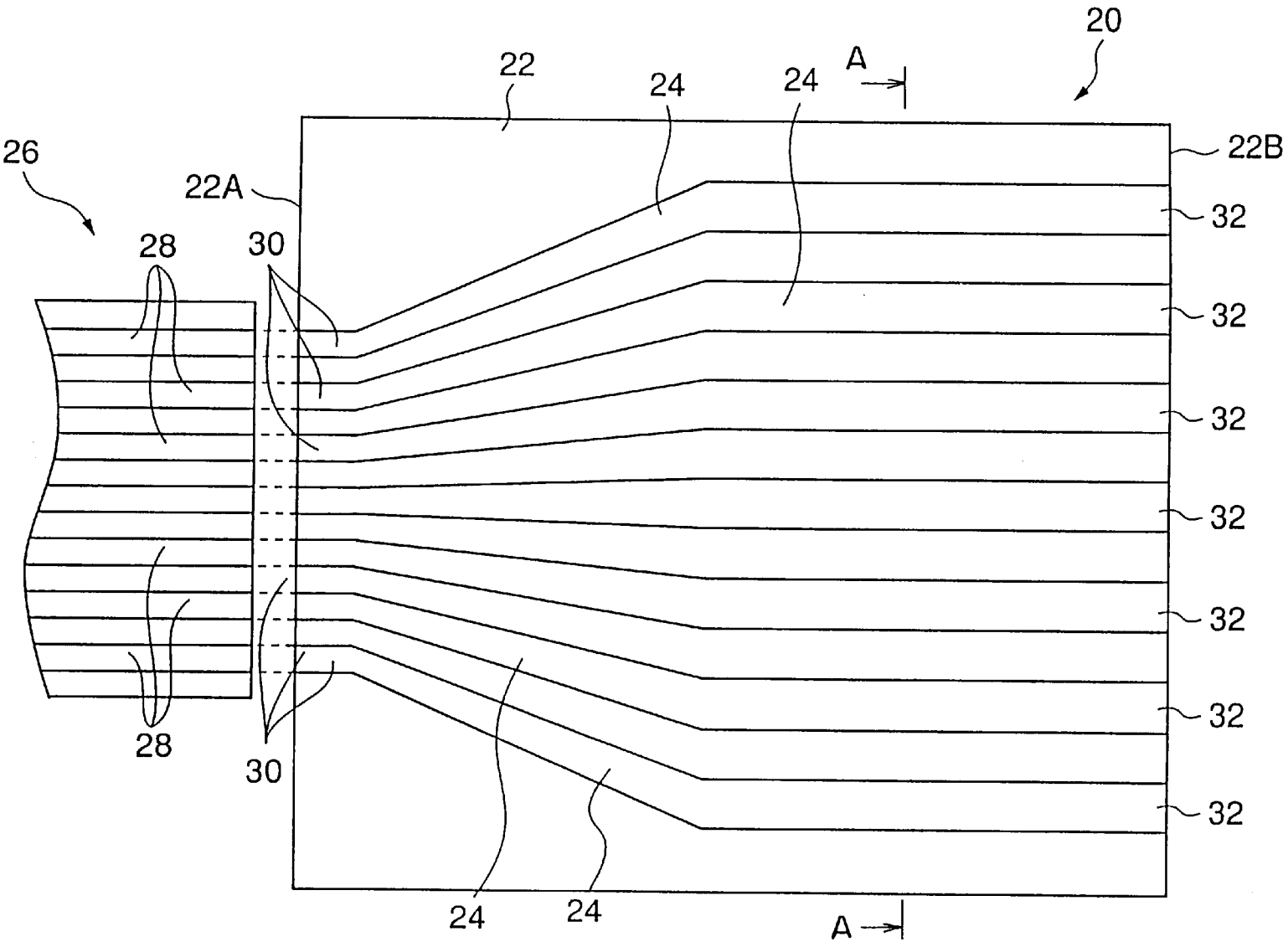
FIG. 1 is a front view showing a pitch converter according to Embodiment 1 of the present invention, showing a narrow-pitch connector and a terminal portion of a connecting subject to which this connector is connected.

FIG. 1 is a front view showing a pitch converter according to this embodiment, and illustrating a narrow-pitch connector and a terminal portion of a connecting subject to which this connector is connected. As shown in FIG. 1, a narrow-pitch connector 20 according to this embodiment has a configuration in which metal wirings 24 are formed on the surface of a substrate 22.

The substrate 22 is composed of rectangular single crystal silicon, and manufactured by cutting a semiconductor wafer into pieces of a lattice so that a semiconductor device is to be formed on the surface of each piece. A plurality of metal wirings 24 are provided on the surface of the substrate 22 so as to cross the substrate 22. Terminal electrodes 30 as bonding portions which can be put on terminal electrodes 28 provided on a connecting subject 26 are formed in one-side end portions of the metal wirings 24 respectively, that is, in an edge portion 22A of the substrate 22. That is, the terminal electrodes 30 are set to have the same pitch (terminal pitch of 60 $\mu$m) as the pitch (for example, terminal pitch of 60 $\mu$m) of the terminal electrodes 28. On the other hand, in an end portion 22B of the substrate 22 opposite to the terminal electrodes 30, terminal electrodes 32 the number of which is equal to the number of the terminal electrodes 30 but the width and pitch of which are enlarged to be not smaller than 80 $\mu$m are formed continuously from the terminal electrodes 30. Thus, the pitch of the electrodes 32 can be fit easily to the pitch of flexible-substrate-side terminals of a flexible substrate, a tape carrier package, or the like, so that a stable connection with such a flexible substrate can be performed. That is, the metal wirings 24 provided on the surface of the substrate 22 makes the terminal electrodes 30 electrically conductive with the terminal electrodes 32 respectively, while the widths of the wirings and the intervals between the wirings are changed between the edge portion 22A and the edge portion 22B so that the narrow pitch of the fine terminal electrodes on the connecting subject 26 side is converted to the enlarged pitch of the terminal electrodes on the flexible substrate side.

Incidentally, in the connecting subject 26 where the terminal electrodes 28 are formed, a piezoelectric element is provided on a silicon substrate composed of the same material as that of the substrate 22. Thus, the connecting subject 26 is provided as a printer head (hereinafter referred to as "printer engine portion") for blasting ink by vibration of the piezoelectric element. By applying voltage to the terminal electrodes 28, the piezoelectric element provided on the connecting subject 26 can be operated (vibrated).

Figure 2:
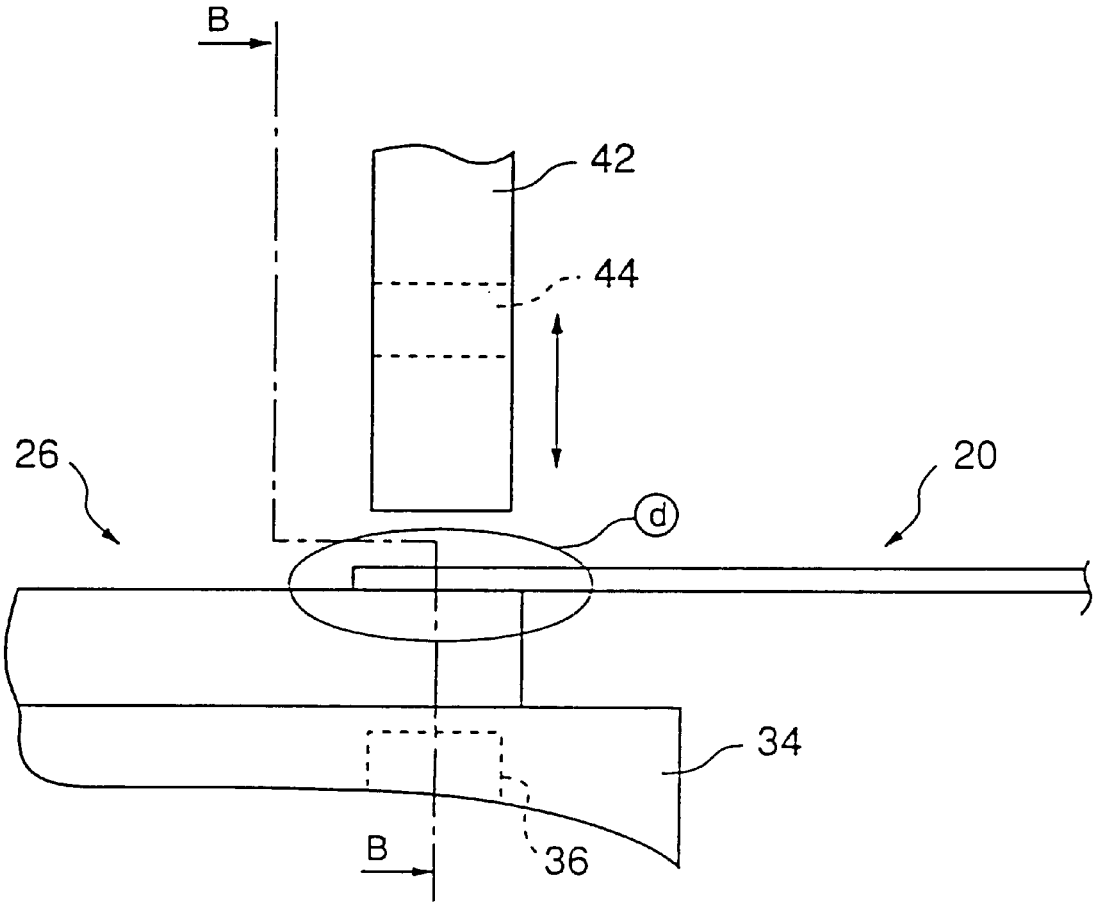
FIG. 2 is an explanatory view showing the process for connecting the connecting subject with the narrow-pitch connector.
Figure 3:
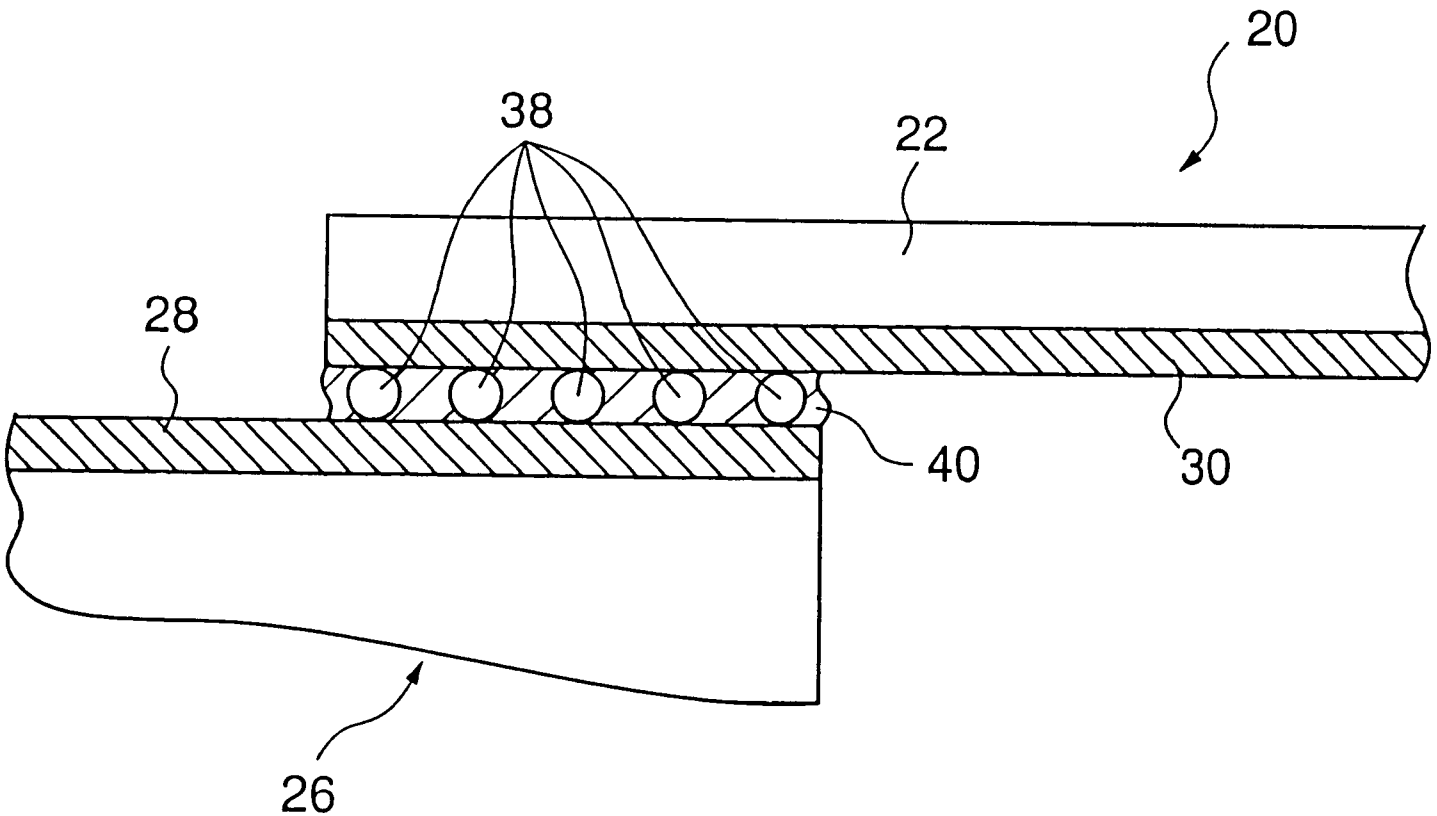
FIG. 3 is an enlarged view of a portion d in FIG. 2.
Figure 4:
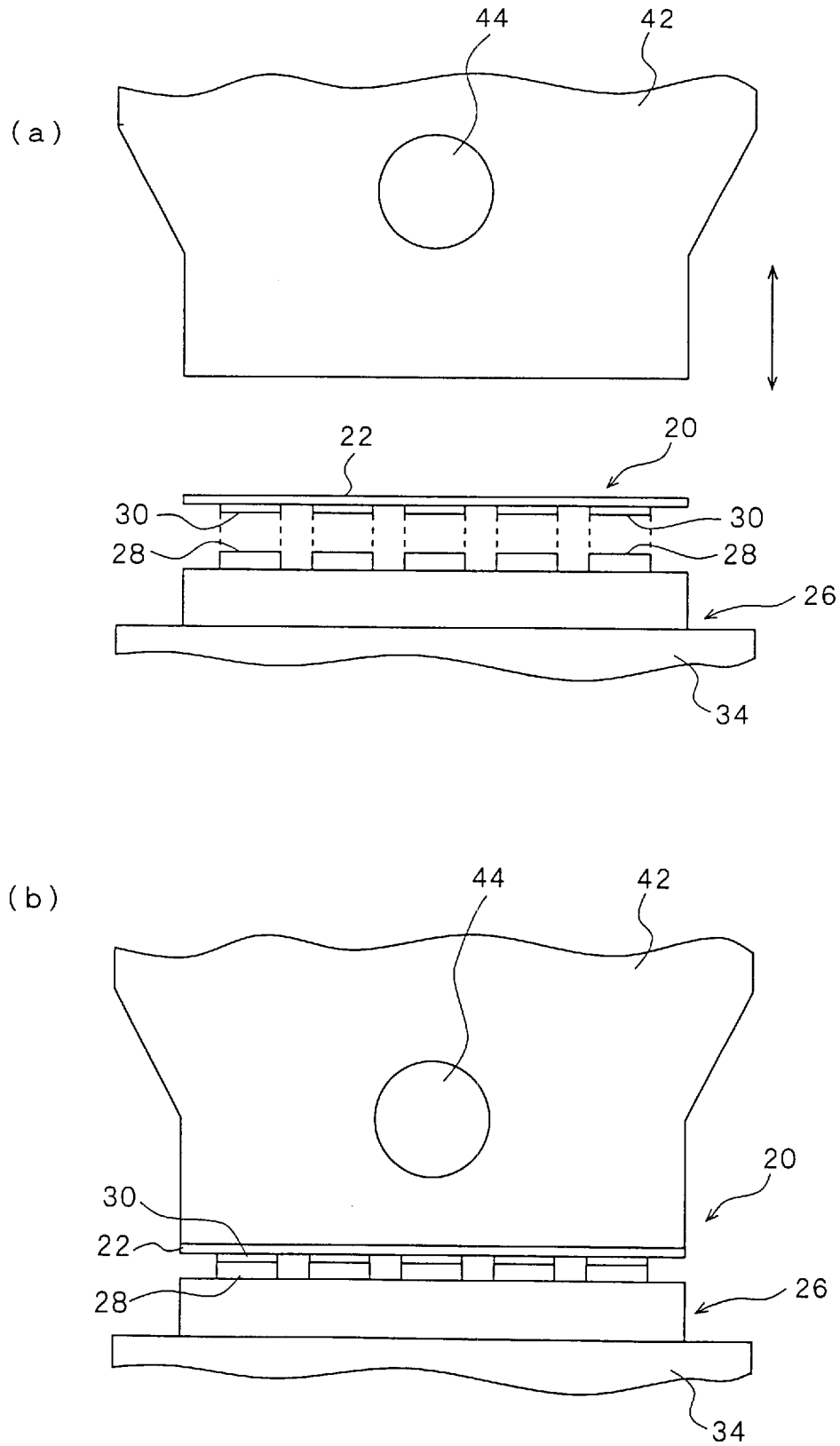
FIGS. 4(*a*) and 4(*b*) are sectional views, respectively, taken on line B—B in FIG. 2, showing the process for connecting the connecting subject with the narrow-pitch connector.

Next, description will be made about the method for connecting electrodes according to the present invention with reference to FIGS. 2 to 4, for example, about the connection between the narrow-pitch connector 20 and the connecting subject 26 each configured as mentioned above. FIG. 2 is an explanatory view of the process in which the terminal electrodes 28 of the connecting subject 26 and the terminal electrodes 30 of the narrow-pitch connector 20 are put on top of each other through electrically conductive members, and connected with each other by pressing and heating. FIG. 3 is an enlarged view of a portion d in FIG. 2, and FIG. 4 is a sectional view taken on line B—B in FIG. 2.

As shown in these drawings, when the narrow-pitch connector 20 is connected to the connecting subject 26, the connecting subject 26 is first installed on the upper surface of a bonding stage 34. A lower heater 36 is provided in the inside of the bonding stage 34. By operating the lower heater 36, the connecting subject 26 and so on can be heated.

Above the connecting subject 26 disposed on the upper surface of the bonding stage 34, the connector 20 is disposed so that the terminal electrodes 30 on the connector side are put on the terminal electrodes 28 of the connecting subject 26. Here, a bonding agent 40 containing electrically conductive particles 38 is applied between the terminal electrodes 28 and the terminal electrodes 30 as shown in FIG. 3. By pressing the connector 20 from the back surface of the connector 20, the electrically conductive particles 38 abut against the terminal electrodes 28 and the terminal electrodes 30 so that these terminal electrodes are made electrically conductive with each other through the electrically conductive particles 38. In addition, the bonding agent 40 containing the electrically conductive particles 38 is accelerated to be solidified by the operation of the lower heater 36 or a heater included in a bonding tool which will be described below.

A bonding tool 42 is disposed above the terminal electrodes 30, that is, above the narrow-pitch connector 20. This bonding tool 42 is attached to a not-shown linear guide so as to be moved up and down along the linear guide. By moving the bonding tool 42 down, the narrow-pitch connector 20 is pressed from its back surface so that the terminal electrodes 28 and the terminal electrodes 30 which are put on top of each other are brought into tight contact through the electrically conductive particles 38. In addition, the bonding tool 42 includes an upper heater 44. By operating the upper heater 44, the front end of the bonding tool 42 is heated so that the narrow-pitch connector 20 can be heated.

Incidentally, the temperatures of the upper and lower heaters 44 and 36 are set so that the temperature around the boundary line between the terminal electrodes 28 and the terminal electrodes 30 is made uniform, that is, no temperature difference arises between the substrate 22 and the connecting subject 26, when the bonding tool 42 is moved down so that the front end of the bonding tool 42 presses the substrate 22 from its back surface. Then, not to say, the temperatures of the upper and lower heaters 44 and 36 are set to be not lower than temperature enough to accelerate the solidification of the bonding agent 40.

After the temperatures of the upper and lower heaters 44 and 36 are set thus, the bonding tool 42 is moved down so that the terminal electrodes 28 and the terminal electrodes 30 are connected with each other respectively from the state shown in FIG. 4(*a*) to the state shown in FIG. 4(*b*).

Incidentally, an anisotropic conductive bonding agent containing the electrically conductive particles 38, or an anisotropic conductive film in which the anisotropic conductive bonding agent is formed into a thin film, is used for the connection between the terminal electrodes 28 and the terminal electrodes 30 so that the terminal electrodes 28 and 30 are brought into tight contact through the electrically conductive particles 38 contained in the bonding agent. However, the electrically conductive particles 38 are not always necessary. In the case where the electrically conductive particles 38 are not interposed, there is taken such a form that the terminal electrodes 28 and the terminal electrodes 30 to be connected with each other are metal-bonded by use of welding or contact bonding.

Here, the substrate 22 and the connecting subject 26 are composed of one and the same material (silicon). In addition, the heating temperatures of the substrate 22 and the connecting subject 26 are equal to each other so that no temperature difference arises therebetween. Accordingly, when the terminal electrodes 28 and the terminal electrodes 30 are connected with each other, the degrees of elongation of the terminal electrodes 28 and 30 caused by heating become equal to each other so that no relative positional deviation between the terminal electrodes 28 and the terminal electrodes 30 arises. As a result, both the terminal electrodes can be bonded with each other surely, so that the disadvantages such as increase in resistance value, a failure in bonding, or short-circuit between adjacent terminals can be prevented from occurring at the time of connection of the electrodes. Incidentally, this embodiment was described about the case where silicon was used as the material composing the substrate 22 and the connecting subject 26 by way of example. In this case, according to various investigations by the present inventor, it was confirmed that connection could be made surely even if the wiring pitch was not larger than 25 $\mu$m, for example, even if the wiring pitch was about 15 $\mu$m. From this fact, it is inferred that connection can be made in accordance with the range of connection resolution even if the wiring pitch is not larger than 15 $\mu$m.

Incidentally, the material of the substrate 22 is not always made the same as that of the connecting subject 26. Even if the materials of the both are different and there is a difference in thermal expansion coefficient therebetween due to the different materials, a temperature difference is set at the time of heating so that the substrate 22 and the connecting subject 26 can be bonded with each other surely. That is, the output values of the upper and lower heaters 44 and 36 are changed so that a temperature difference is produced aggressively between the substrate 22 and the connecting subject 26. Specifically, the temperature of the heater disposed on the side where the thermal expansion coefficient is smaller is set to be higher while the temperature of the heater disposed on the side where the thermal expansion coefficient is larger is set to be lower. By producing a temperature difference aggressively thus, the difference in degree of elongation caused by the difference in thermal expansion coefficient is absorbed so that the relative positions of both the terminal electrodes are made equal to each other. Thus, both the terminal electrodes can be bonded with each other so that disadvantages such as increase in resistance value, a failure in bonding, or short-circuit between adjacent terminals can be prevented from arising at the time of connection of the electrodes.

Figure 5:
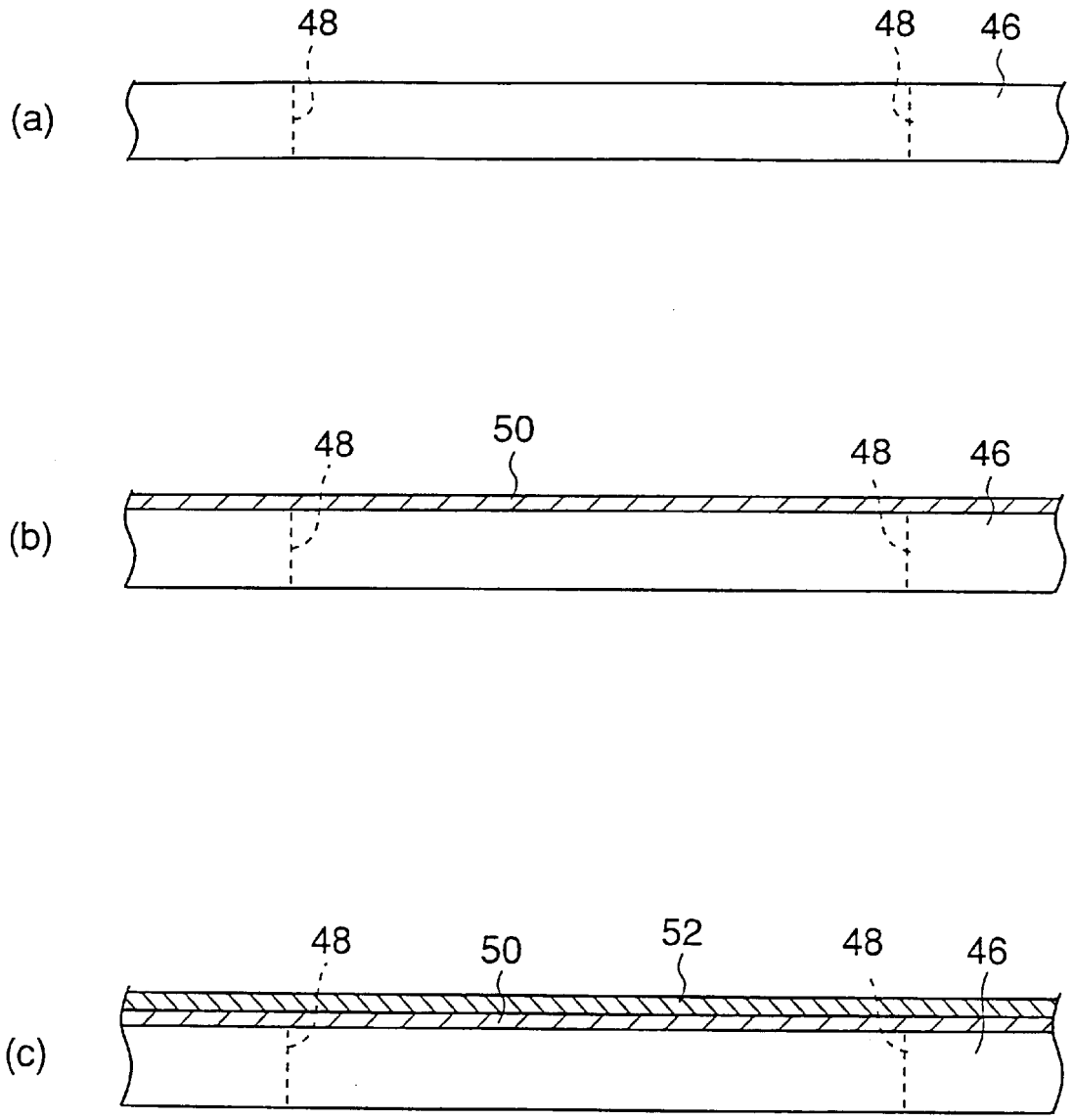
FIGS. 5(*a*) to 5(*c*) are explanatory process views, respectively, showing the process for manufacturing the narrow-pitch connector according to Embodiment 1.
Figure 6:
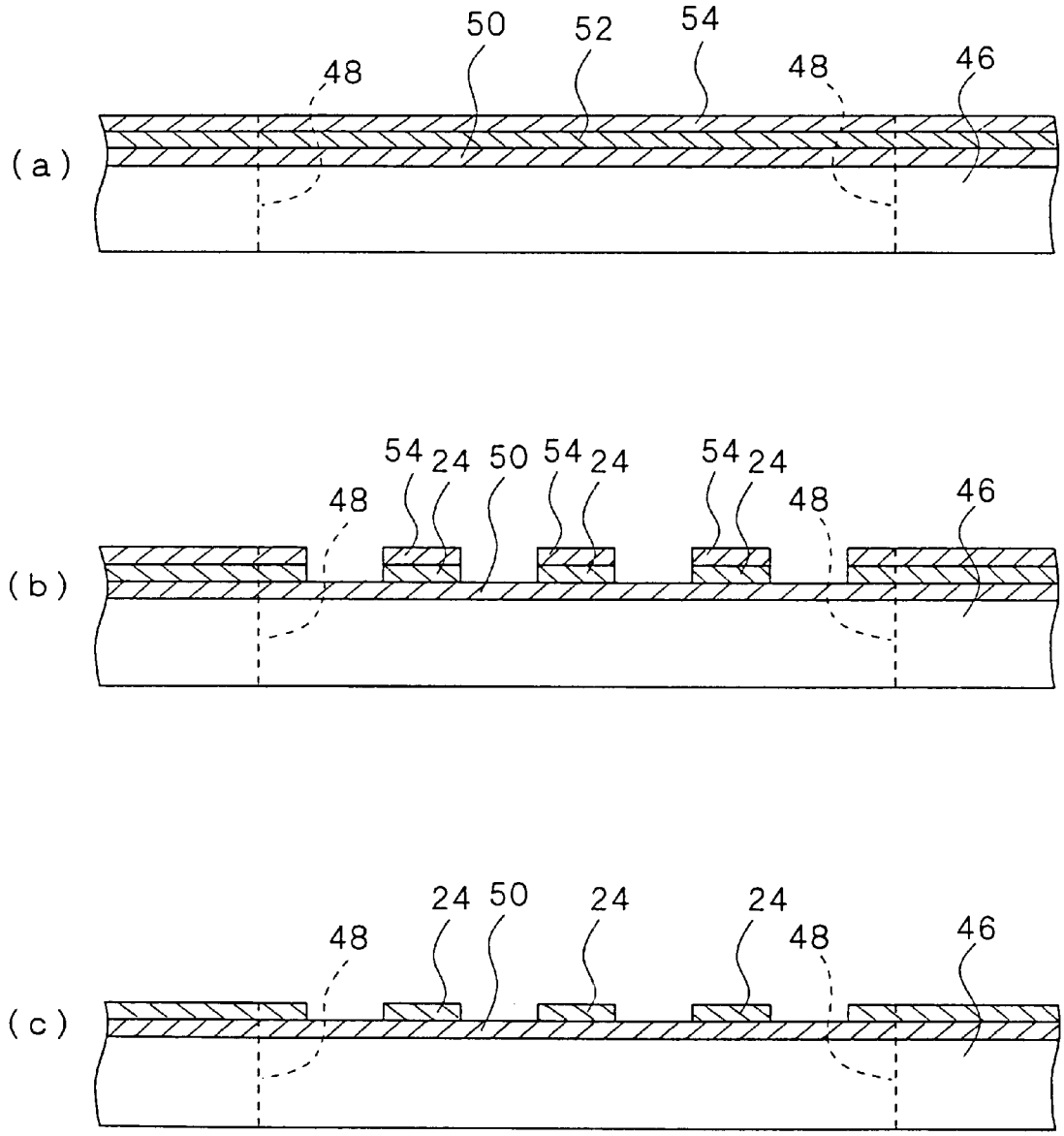
FIGS. 6(*a*) to 6(*c*) are explanatory process views, respectively, showing the process for manufacturing the narrow-pitch connector according to Embodiment 1.

Next, description will be made about the method for manufacturing the narrow-pitch connector according to this embodiment. FIGS. 5 and 6 are process explaining views respectively showing the process for manufacturing the narrow-pitch connector according to this embodiment. Incidentally, in these drawings, the process in which metal wirings are formed on a substrate is shown in the sectional direction taken on line A—A in FIG. 1, and the dotted lines in the respective drawings designate a dicing line 48 for separating narrow-pitch connectors formed adjacently from each other.

First, as shown in FIG. 5(*b*), an insulating film 50 which is 5,000 to 20,000 angstroms thick is formed on the surface of a semiconductor wafer 46, composed of single crystal silicon, shown in FIG. 5(*a*). For example, this insulating film 50 may be formed by use of BPSG (Boron-Phospho-Solicate Glass) deposited by a CVD method, dry thermal oxidation, wet thermal oxidation, or the like.

After the insulating film 50 is formed on the surface of the semiconductor wafer 46 in such a manner, the semiconductor wafer 46 provided with the insulating film 50 is disposed in an argon atmosphere with a pressure of 2 to 5 mTorr and a temperature of 150 to 300° C. Then, sputtering is performed by input power of DC 9 to 12 kW so as to target Al—Cu, Al—Si—Cu, Al—Si, Ni, Cr, Au, etc. Thus, a metal film 52 for forming metal wirings each having the same composition as such targets is deposited to be 200 to 20,000 angstroms thick. Incidentally, the metal film 52 may be formed not in the aforementioned manner but in such a manner that Au may be deposited to be about 1,000 angstroms thick on a primary coat of Cr. This state is shown in FIG. 5(*c*).

After the metal film 52 is formed on the upper surface of the insulating film 50, a photo-resist film 54 is applied onto the metal film 52 as shown in FIG. 6(*a*). Then, patterning is performed by photolithography as shown in FIG. 6(*b*), so that the photo-resist film 54 is removed except the portion where the metal wirings will be formed, and the metal film 52 is etched with the photo-resist film 54 as a mask. Then, as shown in FIGS. 6(*b*) and (*c*), the photo-resist film 54 on the metal wirings 24 formed by etching the metal film 52 is removed. Next, the work of cutting is performed along the dicing lines 48, so that narrow-pitch connectors are cut from the semiconductor wafer 46.

EMBODIMENT 2

Figure 7:
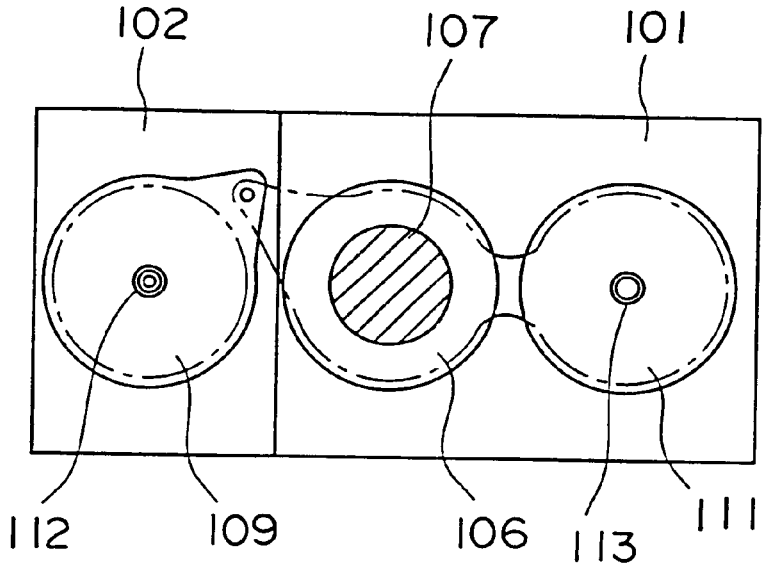
FIGS. 7(*a*) and 7(*b*) are explanatory views, respectively, showing a micro-pump as an example of a micro-machine according to Embodiment 2 of the present invention.
Figure 7:
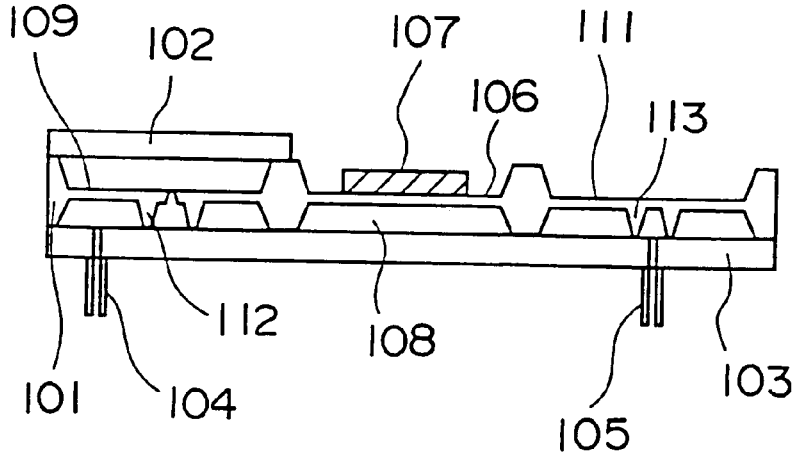

FIG. 7 relates to a micro-pump as an example of a micro-machine according to this embodiment. FIG. 7(*a*) is a top view of the micro-pump, and FIG. 7(*b*) is a sectional view thereof.

The micro-pump has a structure in which a silicon substrate 101 machined by a micro-machining method is sandwiched between two glass plates 102 and 103 so that fluid is sucked from a suction-side pipe 104 and discharged to a discharge-side pipe 105.

The principle of the operation of the micro-pump is as follows. A voltage is applied to a piezoelectric element 107 pasted onto a diaphragm 106 formed in the central portion of the silicon substrate 101 so that the piezoelectric element 107 is bent. As a result, the pressure in a pressure chamber 108 is changed so that a suction-side valve membrane 109 and a discharge-side valve membrane 111 which spatially continue the pressure chamber 108 are displaced. As a result, a suction valve 112 and a discharge valve 113 are opened and closed. Thus, the fluid is compressed and delivered from the suction-side pipe 104 to the discharge-side pipe 105. Incidentally, in FIG. 7(*b*), the pressure chamber 108 continues a space above the suction-side valve membrane 109 and a space under the discharge-side valve membrane 111.

Also in this example, wiring to the outside is performed while temperature control at the time of pressing and heating is performed through a narrow-pitch connector similar to that shown in FIGS. 1 to 3, so that terminals are prevented from relative positional deviation from each other when the terminals are bonded with each other. Thus, by providing the narrow-pitch connector separately, the micro-pump itself can be manufactured with a small size.

Incidentally, in the case where an anisotropic conductive bonding agent containing electrically conductive members, that is, electrically conductive particles, or an anisotropic conductive film in which the anisotropic conductive bonding agent is formed into a thin film, is put between terminal electrodes of the micro-pump and terminal electrodes of the narrow-pitch connector when both the terminal electrodes are bonded with each other, these terminal electrodes to be connected with each other are brought into tight contact through the anisotropic conductive bonding agent or the anisotropic conductive film. On the contrary, in the case where such an anisotropic conductive bonding agent or such an anisotropic conductive film is not interposed, the terminal electrodes to be connected with each other are metal-bonded by use of welding or contact bonding.

EMBODIMENT 3

Figure 8:
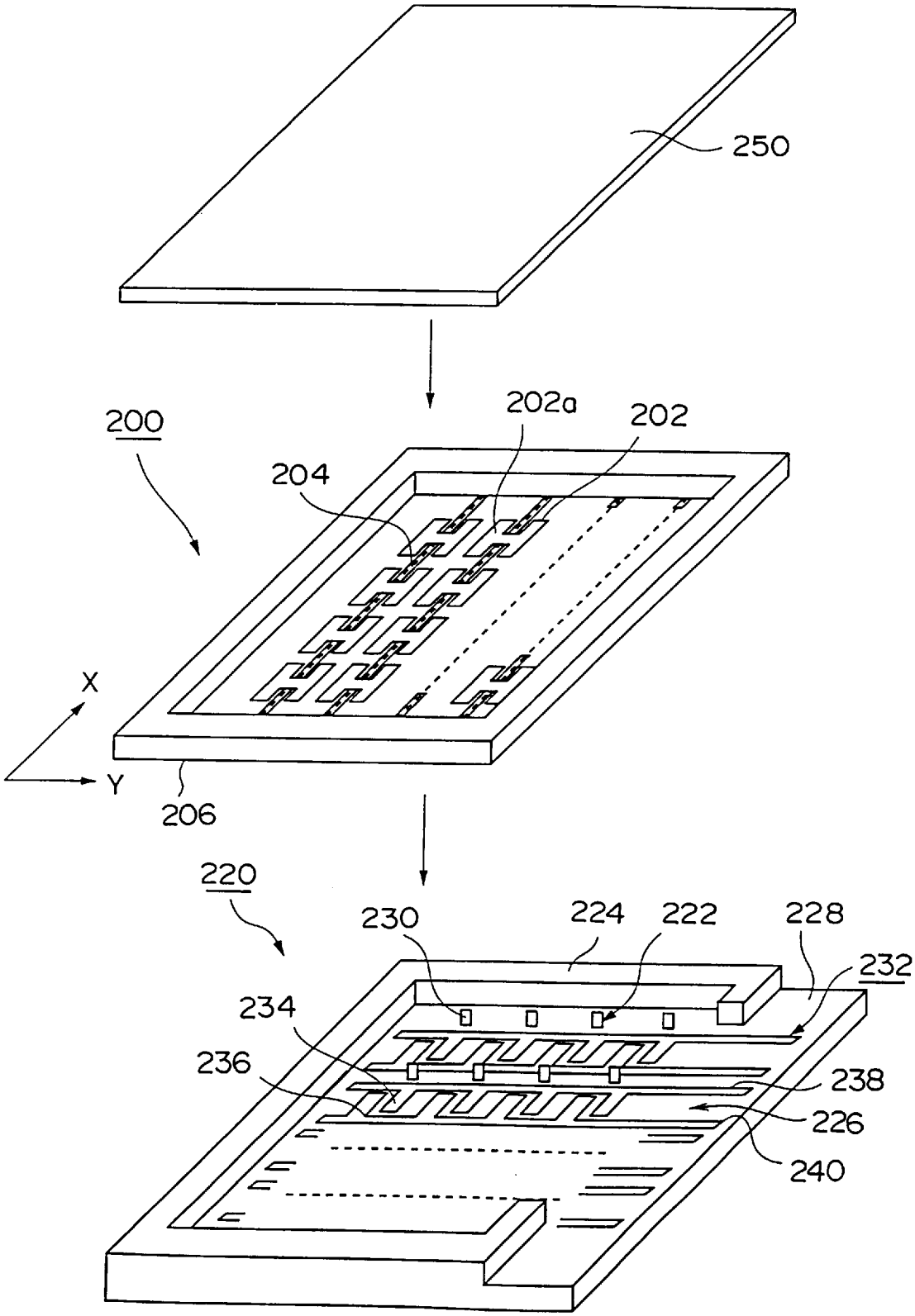
FIG. 8 is a main portion exploded perspective view showing a light modulator as another example according to Embodiment 3 of the present invention.

FIG. 8 is a main portion exploded perspective view showing a light modulator as another example according to this embodiment.

This light modulator is roughly constituted by a silicon substrate 200, a glass substrate 220 and a cover substrate 250.

The silicon substrate 200 has a plurality of micro-mirrors 202 arranged in the form of a matrix. Of these micro-mirrors 102, micro-mirrors 202 arranged in one direction, for example, in a direction X in FIG. 8, are connected with one another by torsion bars 204. Further, a frame-like portion 206 is provided to enclose the area where the plurality of micro-mirrors 202 are arranged. Opposite ends of the plurality of torsion bars 204 are connected to this frame-like portion 206. In addition, slits are formed in the circumferences of the micro-mirrors 202 where the micro-mirrors 202 are connected with the torsion bars 204. By forming these slits, the torsion bars 204 are easily driven so as to incline around the axes thereof. Further, a reflective layer 202*a* is formed on the surface of each micro-mirror 202. Then, when each micro-mirror 202 is driven to incline, the reflecting direction of light incident to this micro-mirror 202 varies. By controlling the time to reflect the light in a predetermined reflecting direction, light modulation can be attained. A circuit for driving the micro-mirrors 202 so as to incline is formed on the glass substrate 220.

The glass substrate 220 has a recess portion 222 in the central area thereof, and has a rising portion 224 around the recess portion 222. One side of the rising portion 224 is cut out to form an electrode take-out port 226. An electrode take-out plate portion 228 continuing the recess portion 222 is formed outside the electrode take-out port 226. In addition, in the recess portion 222 of the glass substrate 220, a large number of columnar support portions 230 are formed to project from the recess portion 222 and to have the same height as that up to the ceiling surface of the rising portion 224, each in the position facing the torsion bar 204 between every two of the micro-mirrors 202 adjacent to each other in the direction X. Further, wiring pattern portions 232 are formed on the recess portion 222 and the electrode take-out plate portion 228 of the glass substrate 220. Each of these wiring pattern portions 232 has first and second address electrodes 234 and 236 in positions opposite to the back surfaces of the micro-mirrors 202 on the opposite sides of the torsion bar 204. Then, the first address electrodes 234 arranged in a direction Y are connected with a first common wiring 238 in common. Similarly, the second address electrodes 236 arranged in the direction Y are connected with a second common wiring 240 in common.

The silicon substrate 200 is anode-bonded onto the glass substrate 220 having the aforementioned structure. At this time, the opposite end portions of the torsion bars 204 and the frame-like portion 206 of the silicon substrate 200 are bonded with the rising portion 224 of the glass substrate 220. Further, the intermediate portions of the torsion bars 204 of the silicon substrate 200 are anode-bonded with the columnar support portions 230 of the glass substrate 220 respectively. Then, the cover substrate 250 is bonded onto the frame-like portion 206 of the silicon substrate 200. The opposite end portions of each torsion bar 104 connected with the frame-like portion 206 are diced in positions where they should be cut from the frame-like portion 206. Further, a circumferential edge portion including the electrode take-out port 226 formed in the rising portion 224 of the glass substrate 220 by cutting is sealed or closed by a sealing material. Thus, a light modulator is completed. Then, a narrow-pitch connector similar to that shown in FIGS. 1 to 3 is connected to the first common wiring 238 and the second common wiring 240 of the completed light modulator. Thus, the light modulator is connected with a flexible substrate such as a tape carrier package mounted with a driving IC, or the like, through the narrow-pitch connector so that signals from the outside are supplied to the light modulator.

Also in this example, the common wirings 238 and 240 are connected with the narrow-pitch connector while the temperature control is performed so that terminals are prevented from relative positional deviation from each other when the terminals are bonded with each other. Thus, by providing the narrow-pitch connector separately, the area occupied by the wiring terminals of the glass substrate 220 can be minimized, so that the light modulator itself can be manufactured with a small size. Incidentally, in the case where an anisotropic conductive bonding agent containing electrically conductive members, that is, electrically conductive particles, or an anisotropic conductive film in which the anisotropic conductive bonding agent is formed into a thin film, is put between the common wirings 238 and 240 as terminal electrodes of the light modulator and the terminal electrodes of the narrow-pitch connector when both the terminal electrodes are bonded with each other, these terminal electrodes to be connected with each other are brought into tight contact through the anisotropic conductive bonding agent or the anisotropic conductive film. On the contrary, in the case where such an anisotropic conductive bonding agent or such an anisotropic conductive film is not interposed, the terminal electrodes to be connected with each other are metal-bonded with each other by use of welding or contact bonding.

EMBODIMENT 4

Figure 9:
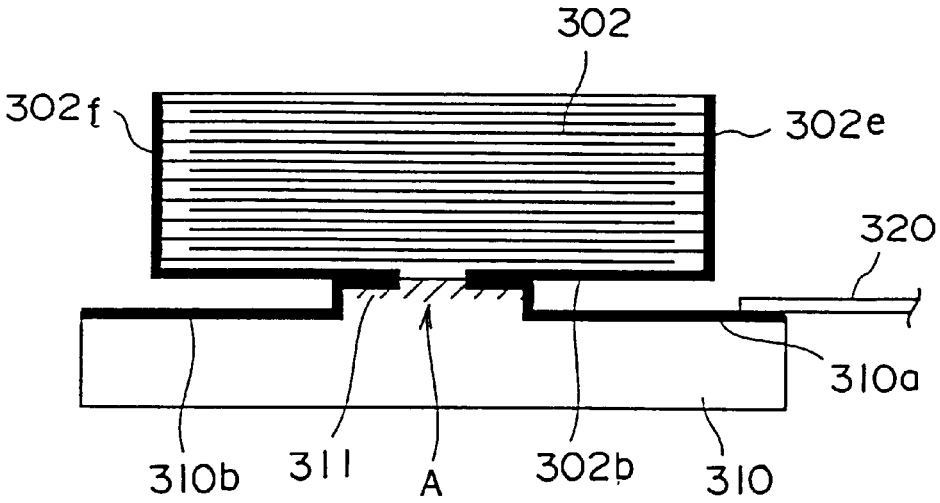
FIG. 9 is an explanatory view showing a piezoelectric actuator according to Embodiment 4 of the present invention.

FIG. 9 is an explanatory view showing a piezoelectric actuator according to this embodiment.

The piezoelectric actuator has a piezoelectric vibrator 302 in which external electrodes 302*e* and 202*f* (portions designated by the thick lines in FIG. 9) are formed on opposite sides, and a holding member 310 for holding this piezoelectric vibrator 302. In the holding member 310, a protrusion portion 311 is formed. The piezoelectric vibrator 302 is bonded with the holding member 310 in a bonding area A of the protrusion portion 311. The external electrodes 302*e* and 302*f* of the piezoelectric vibrator 302 are extended from opposite side surfaces of the piezoelectric vibrator 302 to the middle of a first surface 302*b*, respectively. In addition, electrodes 310*a* and 310*b* formed in the holding member 310 and designated by the thick lines are also extended from opposite outer edges to the middle of the protrusion portion 311. While the piezoelectric vibrator 302 and the holding member 310 are rigidly bonded with each other in the bonding area A set in the protrusion portion 311, the external electrodes 302*e* and 302*f* of the piezoelectric vibrator are connected with the electrodes 310*a* and 310*b* of the holding member so that these electrodes are made electrically conductive with each other. Further, a narrow-pitch connector 320 similar to that shown in FIGS. 1 to 3 is connected with the electrodes 310*a* and 310*b* of the holding member 310. Thus, the electrodes 310*a* and 310*b* of the holding member 310 are connected with a flexible substrate such as a tape carrier package or the like through the narrow-pitch connector 320 so that signals from the outside are supplied to the piezoelectric actuator.

Also in this example, the electrodes 310*a* and 310*b* of the holding member 310 are connected with the narrow-pitch connector 320 while the temperature control is performed so that the terminal electrodes are prevented from relative positional deviation from each other when the terminal electrodes are bonded with each other. Thus, by providing the narrow-pitch connector separately, the area occupied by the wiring terminals of the piezoelectric actuator can be minimized, so that the piezoelectric actuator itself can be manufactured with a small size. At the same time, a large number of piezoelectric actuators can be manufactured from one sheet of wafer, so that the manufacturing cost can be reduced. Incidentally, in the case where an anisotropic conductive bonding agent containing electrically conductive members, that is, electrically conductive particles, or an anisotropic conductive film in which the anisotropic conductive bonding agent is formed into a thin film, is put between the terminal electrodes 310*a* and 310*b* of the piezoelectric actuator and the terminal electrodes of the narrow-pitch connector 320 when both the terminal electrodes are bonded with each other, these terminal electrodes to be connected with each other are brought into tight contact through the anisotropic conductive bonding agent or the anisotropic conductive film. On the contrary, in the case where such an anisotropic conductive bonding agent or such an anisotropic conductive film is not interposed, the terminal electrodes to be connected with each other are metal-bonded with each other by use of welding or contact bonding.

EMBODIMENT 5

Figure 10:
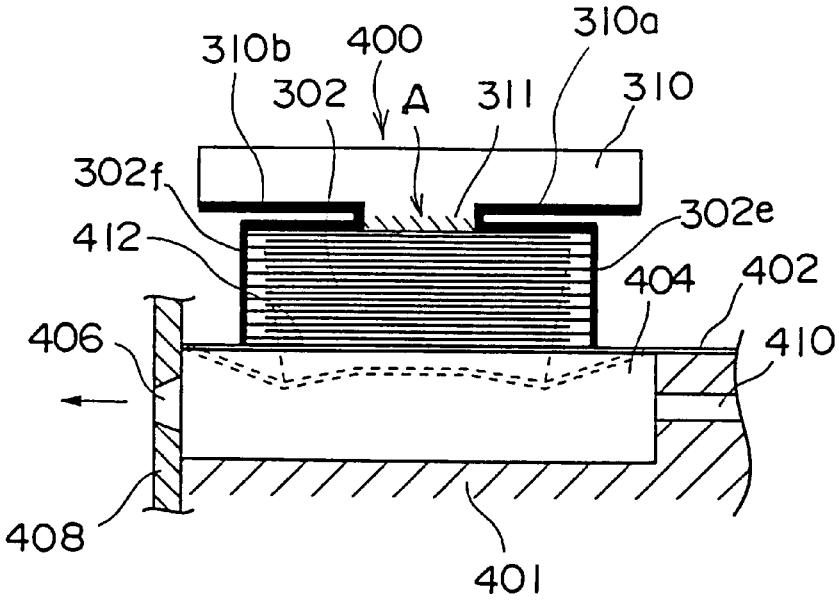
FIG. 10 is a conceptual view showing an ink jet head using the piezoelectric actuator according to Embodiment 5 of the present invention.

FIG. 10 is a conceptual view showing an ink jet head according to this embodiment, using the above-mentioned piezoelectric actuator in FIG. 9. Parts the same as those in FIG. 9 are referenced correspondingly.

In this ink jet head 400, a nozzle plate 408 provided with a nozzle 406 is bonded with a front end of an ink channel 404 formed by a channel formation member 401 and a diaphragm 402. An ink supply channel 410 is disposed at the opposite end to the nozzle plate 408. The piezoelectric actuator is installed so that a mechanical action surface 412 abuts against the diaphragm 402, and the piezoelectric actuator is disposed to face the ink channel 410. Then, the external electrodes 302*e* and 302*f* on the opposite sides of the piezoelectric vibrator 302 are connected with the electrodes 310*a* and 310*b* of the holding member 310. Thus, the electrodes 310*a* and 310*b* of the holding member 310 are connected with a flexible substrate such as a tape carrier package or the like through a narrow-pitch connector 320 (see FIG. 9) similar to that shown in FIGS. 1 to 3, so that signals from the outside are supplied to the piezoelectric actuator.

In this configuration, when ink is charged into the ink channel 410 (up to the front end of the nozzle 406) and the aforementioned piezoelectric actuator is driven, the mechanical action surface 412 produces high efficient expanding deformation and bending deformation simultaneously so as to obtain a very large effective displacement in the up/down direction in FIG. 10. Due to this deformation, the diaphragm 402 is deformed correspondingly to the mechanical action surface 412 as shown by the dotted line in FIG. 10, to generate a large change in pressure (change in volume) in the ink channel 410. Due to this change in pressure, an ink droplet is discharged from the nozzle 406 in the arrow direction in FIG. 10. The ink is discharged very efficiently because of the high efficient pressure change.

Thus, by providing the narrow-pitch connector separately, the area occupied by the wiring terminals of the piezoelectric actuator can be minimized, so that the ink jet head itself can be manufactured with a small size. Incidentally, as described above, in the case where an anisotropic conductive bonding agent containing electrically conductive members, that is, electrically conductive particles, or an anisotropic conductive film in which the anisotropic conductive bonding agent is formed into a thin film, is put between the terminal electrodes 310*a* and 310*b* of the piezoelectric actuator and the terminal electrodes of the narrow-pitch connector 320 when both the terminal electrodes are bonded with each other, these terminal electrodes to be connected with each other are brought into tight contact through the anisotropic conductive bonding agent or the anisotropic conductive film. On the contrary, in the case where such an anisotropic conductive bonding agent or such an anisotropic conductive film is not interposed, the terminal electrodes to be connected with each other are metal-bonded by use of welding or contact bonding.

EMBODIMENT 6

Figure 11:
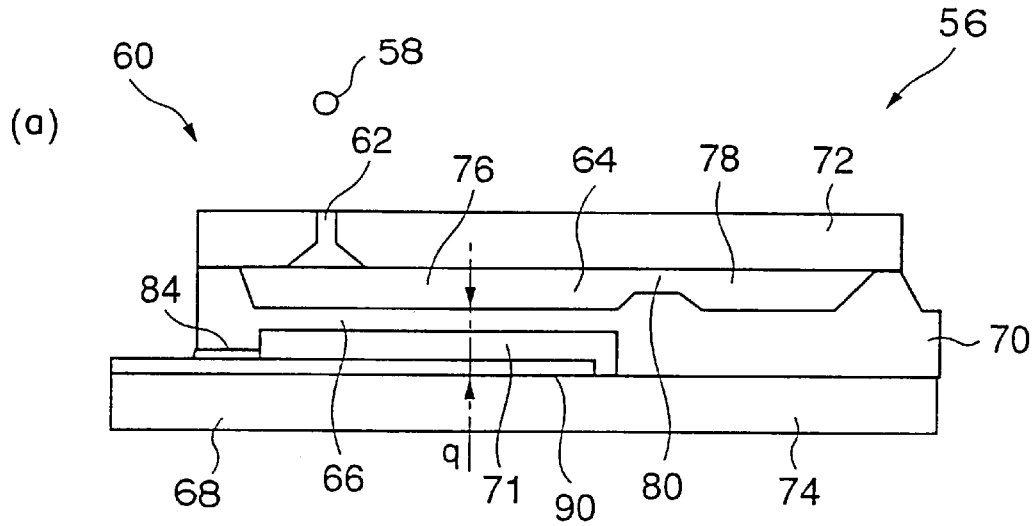
FIGS. 11(*a*) and 11(*b*) are explanatory views showing the structure of an ink jet head using an electrostatic actuator according to Embodiment 6 of the present invention.
Figure 11:
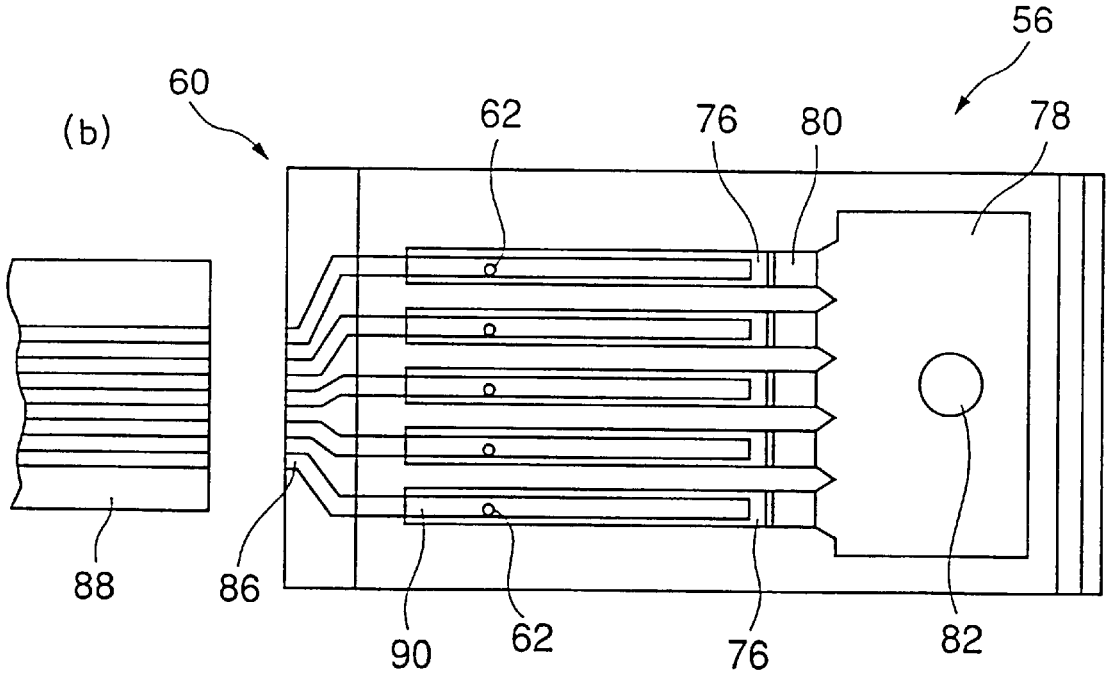

FIGS. 11(*a*) and (*b*) are explanatory views showing the structure of an electrostatic actuator manufactured by use of a micro-machining technology.

An electrostatic actuator 56 is a micro-structure actuator which is used in an ink jet head in an ink jet printer, and which is formed by use of a fine machining technique based on micro-machining technology.

Such a micro-structure actuator uses electrostatic force as a driving source. In an ink jet head 60 for discharging ink droplets 58 by use of such electrostatic force, the bottoms of ink channels 64 communicating with nozzles 62 are formed as diaphragms 66 which will be elastically deformable vibrators respectively. A substrate 68 is disposed in opposition to the diaphragms 66 at a fixed interval (see a size q in FIG. 11(*a*)). Opposed electrodes 90 are disposed over the diaphragms 66 and the surface of the substrate 68, respectively.

When a voltage is applied between the opposed electrodes, the diaphragms 66 are electrostatically attracted toward the substrate 68 due to electrostatic force generated between the opposed electrodes. Thus, the diaphragms 66 vibrate. Due to this vibration of the diaphragms 66, the ink droplets 58 are discharged from the nozzles 62 by the internal pressure change generated in the ink channels 64.

Incidentally, the ink jet head 60 has a three-layer structure in which a silicon substrate 70, a nozzle plate 72 composed of silicon similarly and a glass substrate 74 composed of borosilicate glass are laminated so that the silicon substrate 70. is held between the nozzle plate 72 on the upper side and the glass substrate 74 on the lower side.

Here, in the silicon substrate 70 disposed in the middle, grooves functioning as five independent ink chambers 76, one common ink chamber 78 for connecting these five ink chambers 76 with one another, and ink supply channels 80 for making this common ink chamber 78 communicate with the respective ink chambers 76, are formed by etching the silicon substrate 70 from its surface.

These grooves are closed by the nozzle plate 72 so that the portions are defined. In addition, five independent vibration chambers 71 are formed by etching the silicon substrate 70 from its back side.

In the nozzle plate 72, the nozzles 62 are formed in positions corresponding to front end portions of the respective ink chambers 76 so as to communicate with the respective ink chambers 76.

Further, ink is supplied from a not-shown ink tank to the common ink chamber 78 through an ink supply port 82.

Incidentally, a sealing portion 84 seals fine gaps formed by the opposed electrodes 90 and the silicon substrate 70.

In addition, the respective opposed electrodes 90 of the glass substrate 74 are led out to the end portion side in the left of the drawings so as to form fine-pitch terminal electrodes 86, which are connected to a narrow-pitch connector 88 respectively using a second substrate as a base material according to this embodiment. Incidentally, this connection is performed while temperature control is performed so that the terminal electrodes are prevented from relative positional deviation from each other when the terminal electrodes are bonded with each other.

According to the above description, the terminal electrodes with a narrow pitch can be connected. Thus, connection can be achieved even if the full width of the ink chamber is formed to be narrow. Incidentally, in the case where an anisotropic conductive bonding agent containing electrically conductive members, that is, electrically conductive particles, or an anisotropic conductive film in which the anisotropic conductive bonding agent is formed into a thin film, is put between the terminal electrodes 86 of the glass substrate 74 and the terminal electrodes of the narrow-pitch connector 88 when both the terminal electrodes are bonded with each other, these terminal electrodes to be connected with each other are brought into tight contact through the anisotropic conductive bonding agent or the anisotropic conductive film. On the contrary, in the case where such an anisotropic conductive bonding agent or such an anisotropic conductive film is not interposed, the terminal electrodes to be connected with each other are metal-bonded by use of welding or contact bonding.

EMBODIMENT 7

Figure 12:
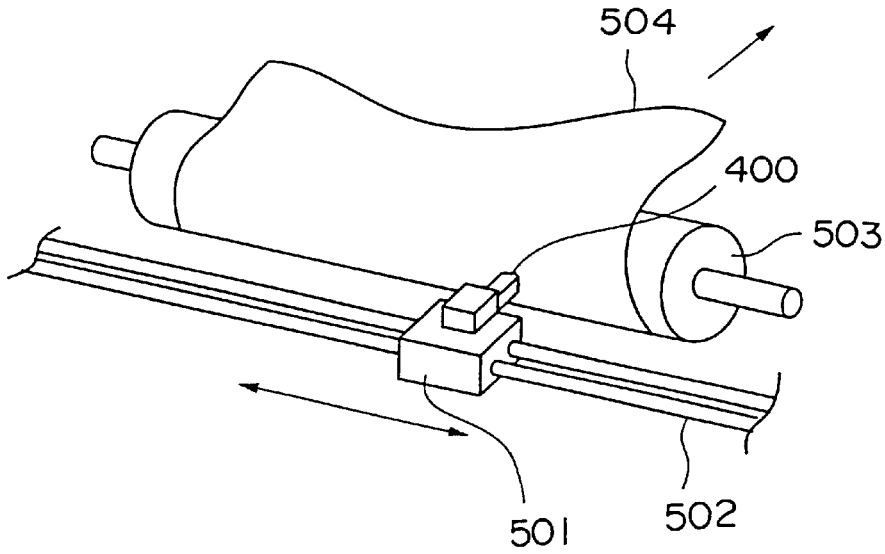
FIG. 12 is an explanatory view showing an example in which an ink jet head according to Embodiment 7 of the present invention is mounted.
Figure 13:
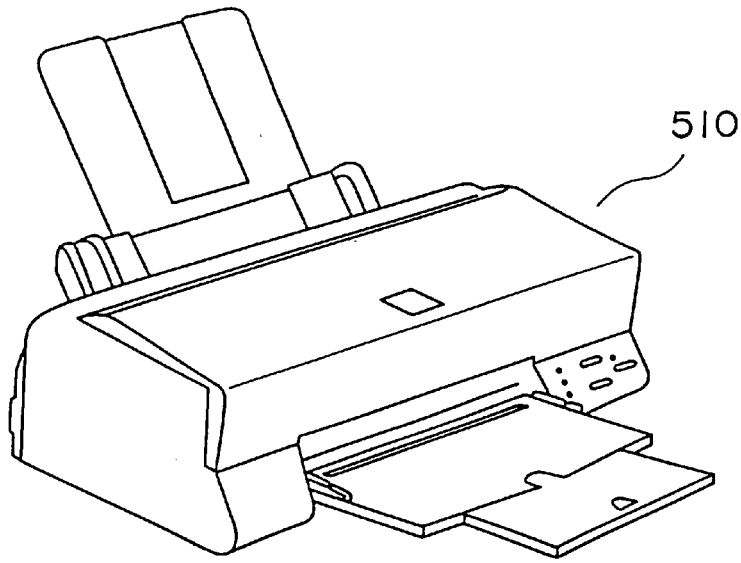
FIG. 13 is an explanatory view showing an ink jet printer according to Embodiment 7.

Incidentally, the aforementioned ink jet head 400 (see FIG. 10) using a piezoelectric actuator according to Embodiment 5 or the aforementioned ink jet head 60 (see FIG. 11) using an electrostatic actuator according to Embodiment 6 is attached to a carriage 501 as shown in FIG. 12 in use. Incidentally, here is shown an example of application of the ink jet head 400 using a piezoelectric actuator. The carriage 501 is movably attached to a guide rail 502, and the position of the carriage 501 is controlled in the direction of the width of paper 504 which is fed out by a roller 503. The mechanism in FIG. 12 is mounted on an ink jet printer 510 shown in FIG. 13. Incidentally, the aforementioned ink jet head 400 can be mounted as a line head of a line printer. In that case, no carriage is required. Although description was made here about the ink jet head 400 which was of a type using a piezoelectric actuator for discharging an ink droplet in the edge direction, and the ink jet printer 510 using the ink jet head 400 by way of example, similar configuration is made also in the case where used is the aforementioned ink jet head 60 which is of a type using an electrostatic actuator according to Embodiment 6 for discharging an ink droplet from the face side.

EMBODIMENT 8

Figure 14:
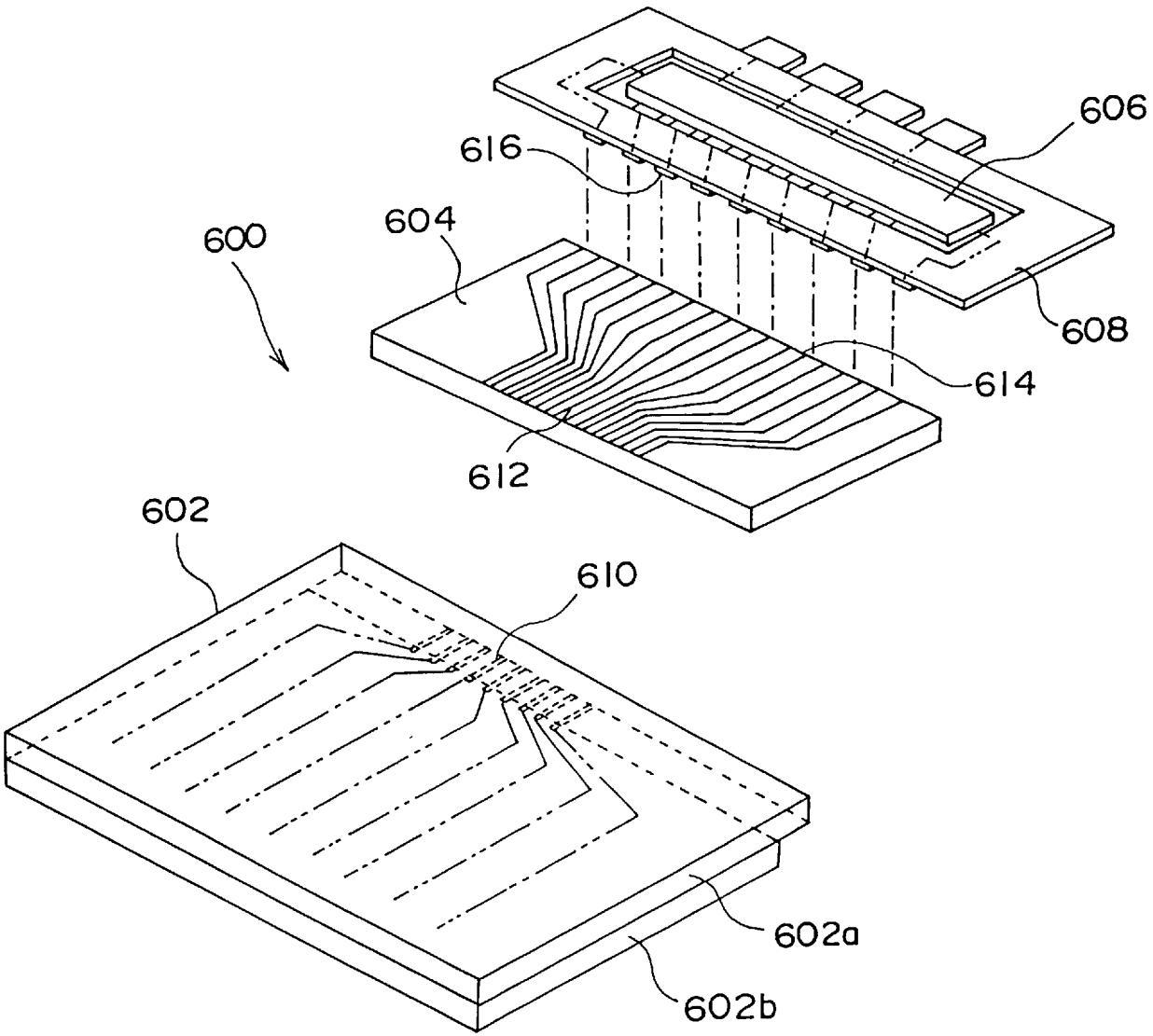
FIG. 14 is an explanatory view showing a liquid crystal device according to Embodiment 8 of the present invention.

FIG. 14 is an explanatory view showing an example of a liquid crystal device according to this embodiment, showing the state after an array process and a cell process have been finished but before the stage of a module process, that is, before electronic circuits such as a driving system or the like are attached so as to be able to control a liquid crystal cell electrically.

A liquid crystal device 600 has a liquid crystal cell 602, a narrow-pitch connector 604, and a tape carrier package 608 mounted with a driving IC 606. The liquid crystal cell 602 is formed by injecting and enclosing a liquid crystal material between a first substrate 602*a* and a second substrate 602*b*. Picture element electrodes, thin film transistors connected to the picture element electrodes, source lines and data lines electrically connected to the sources and gates of the thin film transistors, and so on, are formed on one of the substrates, that is, the first substrate 602*a* (the substrate located on the upper side in FIG. 14). On the other hand, for example, opposed electrodes, color filters, and so on, are disposed on the other substrate, that is, the second substrate 602*b* (the substrate located on the lower side in FIG. 14). In the module process, terminal electrodes (the pitch is not larger than 60 $\mu$m) 610 formed on the liquid crystal cell 602 and fine-pitch terminal electrodes (the pitch is not larger than 60 $\mu$m) 612 of the narrow-pitch connector 604 as a third substrate are put on top of each other, or these terminal electrodes 610 and 612 are put on top of each other through electrically conductive members. Then, the terminal electrodes 610 and 612 are connected with each other by pressing and heating. In addition, terminal electrodes (the pitch is not smaller than 80 $\mu$m) 614 at the end of a wiring pattern which is expanded and extended from the other ends of the fine-pitch terminal electrodes 612 of the narrow-pitch connector 604, are connected with terminal electrodes 616 of the tape carrier package 608 respectively. Thus, the terminal electrodes 610 are made electrically conductive with the driving IC 606.

Thus, by providing the narrow-pitch connector 604 as the third substrate separately, the area occupied by the terminal electrodes 610 in the liquid crystal cell 602 can be minimized. As a result, a large display portion in the liquid crystal cell can be ensured even if the liquid crystal cell has the same area as that of a background-art one. In addition, because the connection can be achieved with a narrow pitch, the number of terminals in a connection portion can be increased. Accordingly, the wiring pitch and the picture element pitch can be reduced, so that high precision can be obtained. Further, if the narrow-pitch connector 604 is formed from a material the thermal expansion coefficient of which is substantially equal to or smaller than that of the material of the liquid crystal cell 602, the thermal expansion coefficient of the narrow-pitch connector becomes substantially equal to or smaller than that of the liquid crystal cell when the terminal electrodes of the liquid crystal cell are bonded with the terminal electrodes of the narrow-pitch connector which is to be bonded with the terminal electrodes of the liquid crystal cell. The terminal electrodes can be prevented from relative positional deviation from each other when both the terminal electrodes are bonded with each other.

Incidentally, in the case where an anisotropic conductive bonding agent containing electrically conductive members, that is, electrically conductive particles, or an anisotropic conductive film in which the anisotropic conductive bonding agent is formed into a thin film, is put between the terminal electrodes 610 of the liquid crystal cell 602 and the terminal electrodes 612 of the narrow-pitch connector 604 when both the terminal electrodes are bonded with each other, these terminal electrodes to be connected with each other are brought into tight contact through the anisotropic conductive bonding agent or the anisotropic conductive film. On the contrary, in the case where such an anisotropic conductive bonding agent or such an anisotropic conductive film is not interposed, the terminal electrodes to be connected with each other are metal-bonded by use of welding or contact bonding.

EMBODIMENT 9

Figure 15:
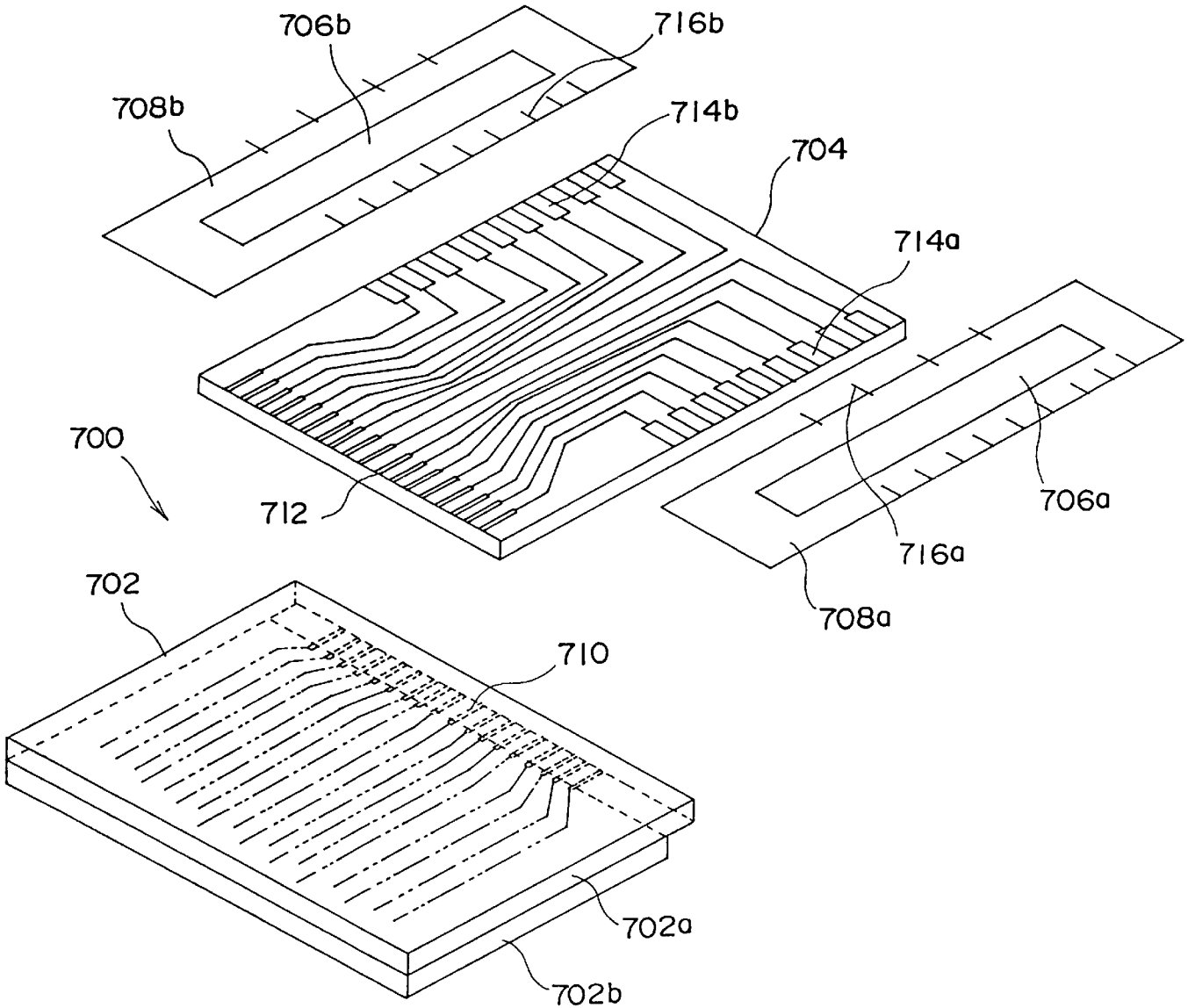
FIG. 15 is an explanatory view showing a liquid crystal device according to Embodiment 9 of the present invention.

FIG. 15 is an explanatory view showing another example of a liquid crystal device according to this embodiment, showing the state after an array process and a cell process have been finished but before the stage of a module process, that is, before electronic circuits such as a driving system or the like are attached so as to be able to control a liquid crystal cell electrically.

A liquid crystal device 700, in which the number of terminals in a connection portion is increased and the picture element pitch is reduced so that the liquid crystal device with high precision is obtained, has a liquid crystal cell 702, a narrow-pitch connector 704, tape carrier packages 708*a* and 708*b* which are mounted with driving ICs 706*a* and 706*b* respectively and which are to be connected to the opposite sides, respectively, of the narrow-pitch connector 704. The liquid crystal cell 702 is formed by injecting and enclosing a liquid crystal material between a first substrate 702*a* and a second substrate 702*b*. Picture element electrodes, thin film transistors connected to the picture element electrodes, source lines and data lines electrically connected to the sources and gates of the thin film transistors, and so on, are formed on one of the substrates, that is, the first substrate 702*a* (the substrate located on the upper side in FIG. 15). On the other hand, for example, opposed electrodes, color filters, and so on, are disposed on the other substrate, that is, the second substrate 702*b* (the substrate located on the lower side in FIG. 15). In the module process, terminal electrodes (the pitch is not larger than 60 μm) 710 formed on the liquid crystal cell 702 and fine-pitch terminal electrodes (the pitch is not larger than 60 μm) 712 of the narrow-pitch connector 704 as a third substrate are put on top of one another, or these terminal electrodes 710 and 712 are put on top of each other through electrically conductive members. Then, the terminal electrodes 710 and 712 are connected with each other by pressing and heating. In addition, the end of a wiring pattern which is expanded and extended from the other ends of the fine-pitch terminal electrodes 712 of the narrow-pitch connector 704 is distributed on the left and the right so as to form terminal electrodes (the pitch is not smaller than 80 μm) 714*a* and 714*b*. The terminal electrodes 714*a* and 714*b* are connected with terminal electrodes 716*a* and 716*b* of the left and right tape carrier packages 708*a* and 708*b* respectively. Thus, the terminal electrodes 710 are made electrically conductive with the driving ICs 706*a* and 706*b*.

Thus, by providing the narrow-pitch connector 704 as the third substrate separately, the number of terminal electrodes 710 in the liquid crystal cell 702 can be increased. Accordingly, the wiring pitch and the picture element pitch can be reduced so that high precision can be obtained. Further, if the narrow-pitch connector 704 is formed from a material the thermal expansion coefficient of which is substantially equal to or smaller than that of the material of the liquid crystal cell 702, the thermal expansion coefficient of the narrow-pitch connector becomes substantially equal to or smaller than that of the liquid crystal cell when the terminal electrodes of the liquid crystal cell are bonded with the terminal electrodes of the narrow-pitch connector which are to be bonded with the terminal electrodes of the liquid crystal cell. Therefore, the terminal electrodes are prevented from relative positional deviation from each other when both the terminal electrodes are bonded with each other.

Incidentally, in the case where an anisotropic conductive bonding agent containing electrically conductive members, that is, electrically conductive particles, or an anisotropic conductive film in which the anisotropic conductive bonding agent is formed into a thin film, is put between the terminal electrodes 710 of the liquid crystal cell 702 and the terminal electrodes 712 of the narrow-pitch connector 704 when both the terminal electrodes are bonded with each other, these terminal electrodes to be connected with each other are brought into tight contact through the anisotropic conductive bonding agent or the anisotropic conductive film. On the contrary, in the case where such an anisotropic conductive bonding agent or such an anisotropic conductive film is not interposed, the terminal electrodes to be connected with each other are metal-bonded by use of welding or contact bonding.

EMBODIMENT 10

Figure 16:
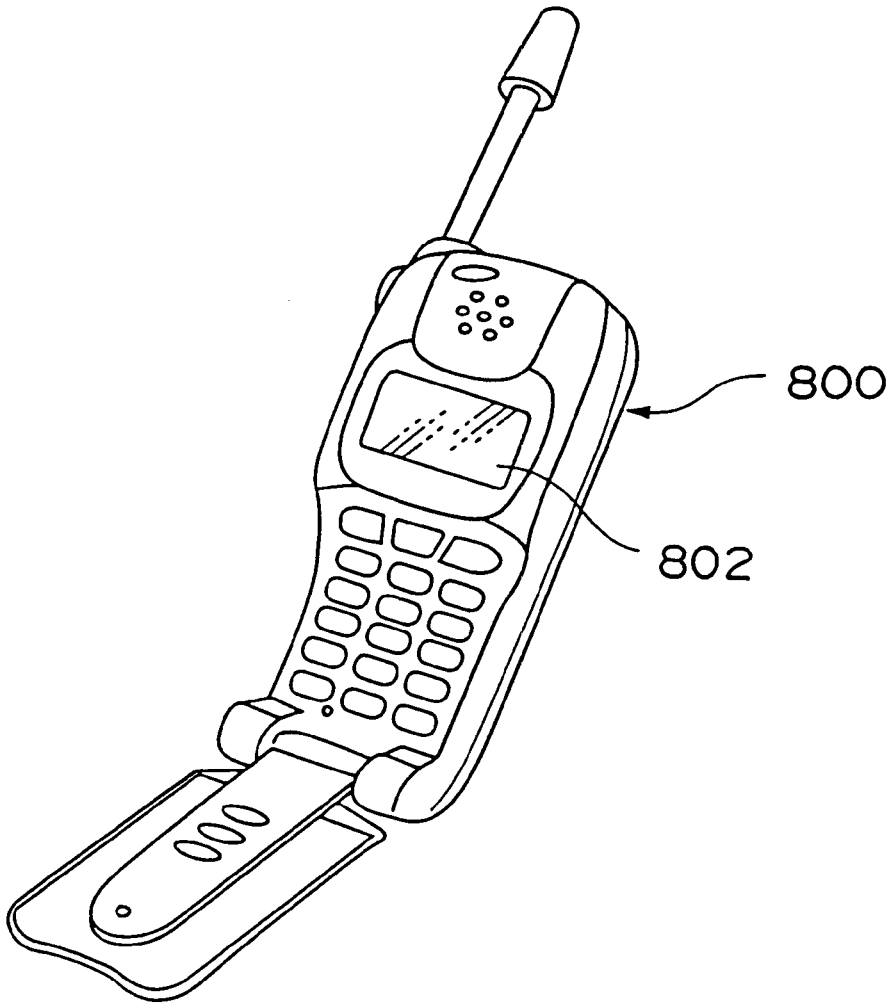
FIG. 16 is an explanatory view showing a portable telephone as an example of electronic equipment using a liquid crystal device according to Embodiment 10 of the present invention.
Figure 17:
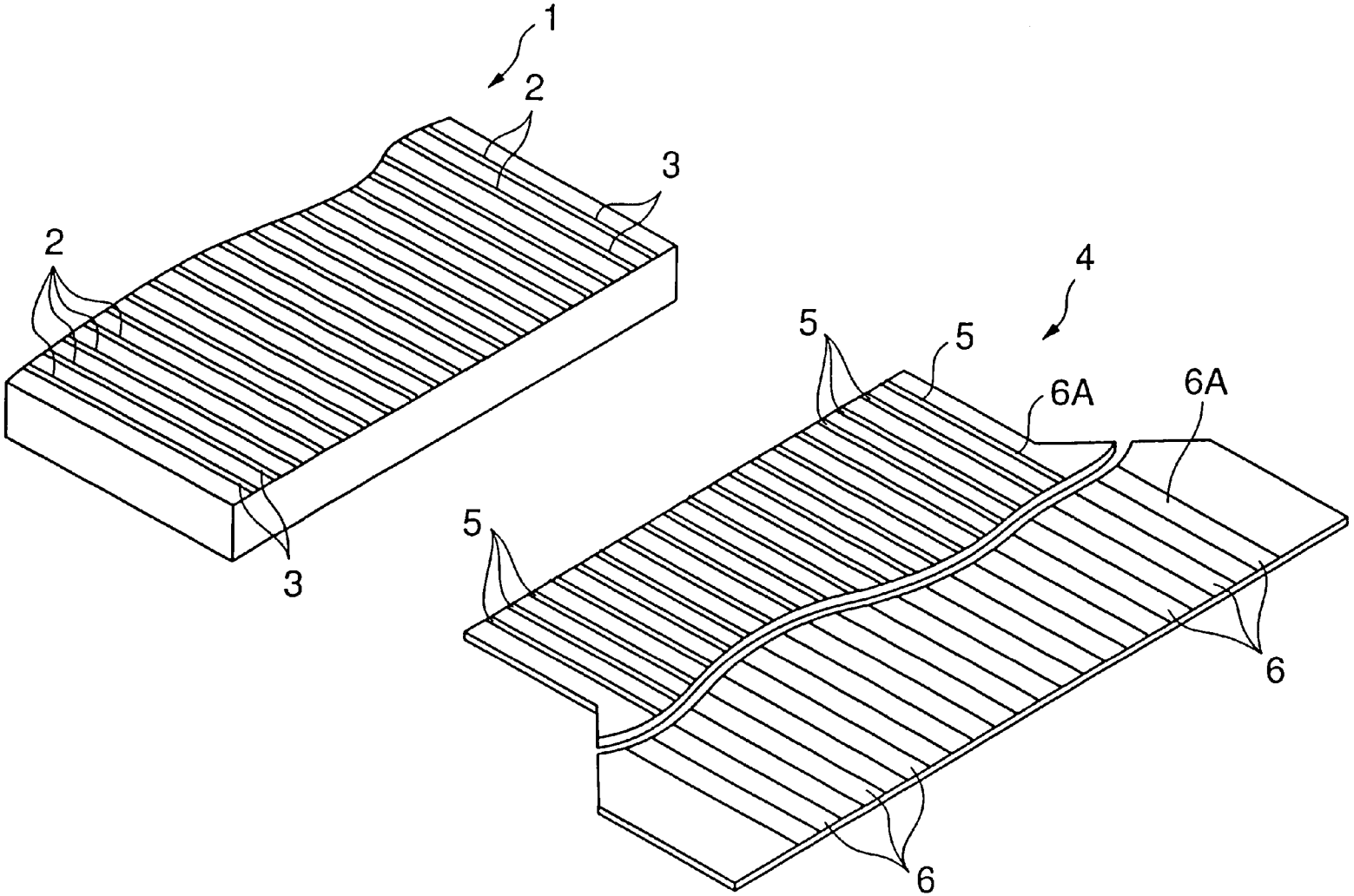
FIG. 17 is a main portion enlarged view of a connecting subject and a connector constituted by a flexible substrate in the background art.
Figure 18:
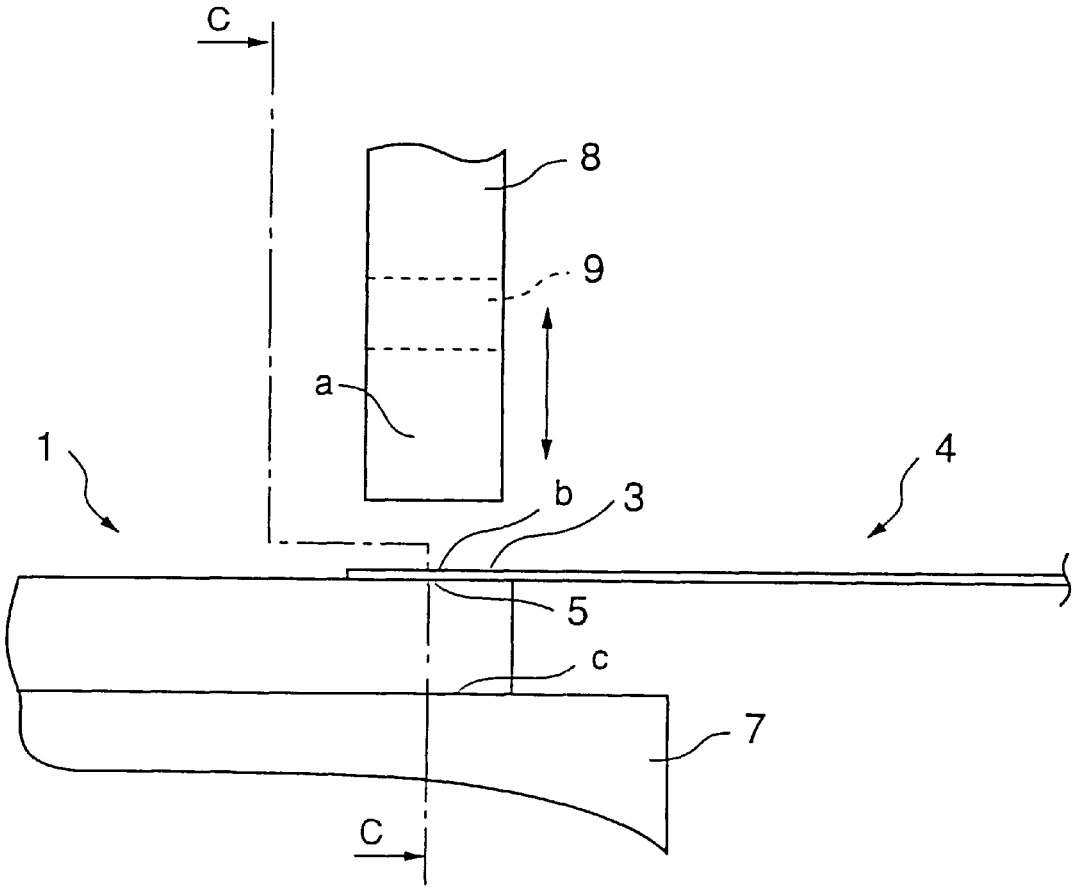
FIG. 18 is an explanatory view showing the process for connecting the connecting subject and the connector in the background art.
Figure 19:
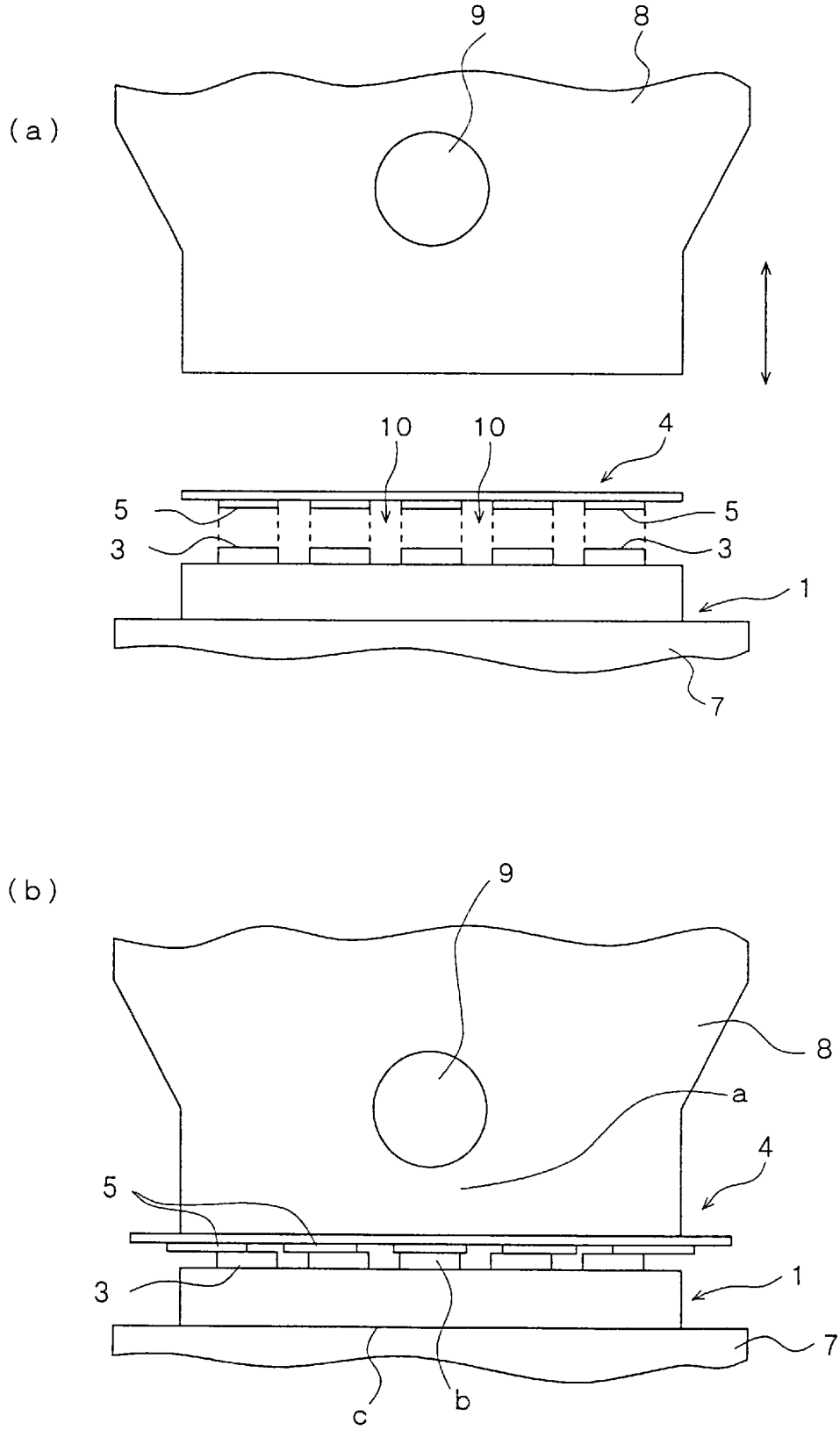
FIGS. 19(*a*) and 19(*b*) are sectional views, respectively, taken on line C—C in FIG. 18, showing the process for connecting the connecting subject and the connector in the background art.

FIG. 16 shows a portable telephone which is an example of electronic equipment using the liquid crystal device shown in Embodiment 8 or 9.

The liquid crystal device is used in a display portion 802 of a portable telephone 800 shown in FIG. 16. Accordingly, the picture element pitch of the liquid crystal device can be reduced by use of the narrow-pitch connector, so that a liquid crystal device with high precision can be obtained. As a result, the portable telephone 800 with the display portion 802 easy to view can be realized though it is small in size.

What is claimed is:

1. A narrow-pitch connector, in which a plurality of first terminal electrodes and a plurality of second terminal electrodes are formed on a substrate, and wiring is formed for electrically connecting said first terminal electrodes with said second terminal electrodes, said wiring having a function of making a conversion from a pitch of said first terminal electrodes to a pitch of said second terminal electrodes; characterized in that said substrate is formed of single crystal silicon.

2. A narrow-pitch connector according to claim 1, characterized in that said first terminal electrodes are arranged so that said pitch of said first terminal electrodes is set to be not larger than 60 μm.

3. A narrow-pitch connector according to claim 2, characterized in that said second terminal electrodes are arranged so that said pitch of said second terminal electrodes is set to be not smaller than 80 $\mu$m.

4. A narrow-pitch connector according to claim 3, characterized in that said second terminal electrodes are terminal electrodes for making a connection with a flexible substrate such as a flexible board, a tape carrier package, or the like.

5. A pitch converter, characterized by comprising:

a narrow-pitch connector in which a plurality of first terminal electrodes and a plurality of second terminal electrodes are formed on a second substrate formed of single crystal silicon, and wiring is formed for electrically connecting said first terminal electrodes with said second terminal electrodes, said wiring having a function of making a conversion from a pitch of said first terminal electrodes to a pitch of second terminal electrodes; and a connecting subject provided with a first substrate having external electrodes which are to be electrically connected with said first terminal electrodes.

6. A pitch converter according to claim 5, characterized in that said first substrate of the connecting subject has a characteristic that a thermal expansion coefficient thereof is substantially equal to or larger than a thermal expansion coefficient of said second substrate.

7. A pitch converter according to claim 5, characterized in that said first substrate of the connecting subject is formed of single crystal silicon.

8. A pitch converter according to claim 5, characterized in that said first terminal electrodes are electrically connected with said external electrodes through electrically conductive members.

9. A method for connecting electrodes, by which terminal electrodes formed in a narrow-pitch connector having a pitch converting function are respectively connected with external electrodes formed in a connecting subject; characterized in that heating conditions are established on the basis of a difference in thermal expansion coefficient between said narrow-pitch connector and said connecting subject, and an area where said terminal electrodes are connected with said external electrodes respectively is pressed and heated.

10. A method according to claim 9, characterized in that said area is heated by a first heater and a second heater from the side of said terminal electrodes and the side of said external electrodes respectively under said heating conditions.

11. A micro-machine comprising a moving mechanism portion and a first substrate in which a plurality of external electrodes are formed; characterized in that:

said micro-machine is provided with a second substrate formed of single crystal silicon in which first terminal electrodes for making an electric connection with said plurality of external electrodes are formed;

a plurality of second terminal electrodes and wiring for electrically connecting said first terminal electrodes with said second terminal electrodes respectively are formed on said second substrate, said wiring having a function of making a conversion from a pitch of said first terminal electrodes to a pitch of said second terminal electrodes.

12. A piezoelectric actuator comprising a piezoelectric element and a first substrate in which a plurality of external electrodes are formed; characterized in that:

said piezoelectric actuator is provided with a second substrate formed of single crystal silicon in which first terminal electrodes for making an electric connection with said plurality of external electrodes are formed;

a plurality of second terminal electrodes and wiring for electrically connecting said first terminal electrodes with said second terminal electrodes respectively are formed on said second substrate, said wiring having a function of making a conversion from a pitch of said first terminal electrodes to a pitch of said second terminal electrodes.

13. An electrostatic actuator comprising an electrostatic vibrator and a first substrate in which a plurality of external electrodes are formed; characterized in that:

said electrostatic actuator is provided with a second substrate formed of single crystal silicon in which first terminal electrodes for making an electric connection with said plurality of external electrodes are formed;

a plurality of second terminal electrodes and wiring for electrically connecting said first terminal electrodes with said second terminal electrodes respectively are formed on said second substrate, said wiring having a function of making a conversion from a pitch of said first terminal electrodes to a pitch of said second terminal electrodes.

14. An ink jet head comprising a piezoelectric element and a first substrate in which a plurality of external electrodes are formed, so as to discharge ink drops by said piezoelectric element; characterized in that:

said ink jet head is provided with a second substrate formed of single crystal silicon in which first terminal electrodes for making an electric connection with said plurality of external electrodes are formed;

a plurality of second terminal electrodes and wiring for electrically connecting said first terminal electrodes with said second terminal electrodes respectively are formed on said second substrate, said wiring having a function of making a conversion from a pitch of said first terminal electrodes to a pitch of said second terminal electrodes.

15. An ink jet head comprising an electrostatic vibrator and a first substrate in which a plurality of external electrodes are formed, so as to discharge ink drops by said electrostatic vibrator; characterized in that:

said ink jet head is provided with a second substrate formed of single crystal silicon in which first terminal electrodes for making an electric connection with said plurality of external electrodes are formed;

a plurality of second terminal electrodes and wiring for electrically connecting said first terminal electrodes with said second terminal electrodes respectively are formed on said second substrate, said wiring having a function of making a conversion from a pitch of said first terminal electrodes to a pitch of said second terminal electrodes.

16. An ink jet printer comprising an ink jet head having a piezoelectric element and a first substrate, said first substrate being provided with a plurality of external electrodes formed therein; characterized in that:

said ink jet printer is provided with a second substrate formed of single crystal silicon in which first terminal electrodes for making an electric connection with said plurality of external electrodes are formed;

a plurality of second terminal electrodes and wiring for electrically connecting said first terminal electrodes with said second terminal electrodes respectively are formed on said second substrate, said wiring having a function of making a conversion from a pitch of said first terminal electrodes to a pitch of said second terminal electrodes.

17. An ink jet printer comprising an ink jet head having an electrostatic vibrator and a first substrate, said first substrate being provided with a plurality of external electrodes formed therein; characterized in that:

said ink jet printer is provided with a second substrate formed of single crystal silicon in which first terminal electrodes for making an electric connection with said plurality of external electrodes are formed;

a plurality of second terminal electrodes and wiring for electrically connecting said first terminal electrodes with said second terminal electrodes respectively are formed on said second substrate, said wiring having a function of making a conversion from a pitch of said first terminal electrodes to a pitch of said second terminal electrodes.

18. A liquid crystal device in which a liquid crystal is held between a pair of first substrates, and a plurality of external electrodes are formed on either of said first substrates; characterized in that:

said liquid crystal device is provided with a second substrate formed of single crystal silicon in which first terminal electrodes for making an electric connection with said plurality of external electrodes are formed;

a plurality of second terminal electrodes and wiring for electrically connecting said first terminal electrodes with said second terminal electrodes respectively are formed on said second substrate, said wiring having a function of making a conversion from a pitch of said first terminal electrodes to a pitch of said second terminal electrodes.

19. An electronic equipment comprising a liquid crystal device; characterized in that said liquid crystal device includes a pair of first substrates so that a liquid crystal is held between said first substrates, either of said first substrates being provided with a plurality of external electrodes, and further includes a second substrate formed of single crystal silicon in which first terminal electrodes for making an electric connection with said plurality of external electrodes are formed;

a plurality of second terminal electrodes and wiring for electrically connecting said first terminal electrodes with said second terminal electrodes respectively are formed on said second substrate, said wiring having a function of making a conversion from a pitch of said first terminal electrodes to a pitch of said second terminal electrodes.

* * * * *